US007114719B2

(12) United States Patent
Steenstra et al.

(10) Patent No.: US 7,114,719 B2
(45) Date of Patent: Oct. 3, 2006

(54) [MANAGEMENT TRAINING] GAME ACTIVITY

(76) Inventors: Daniel Steenstra, 20 Ladbroke Hall, Ladbroke, Leemington Spa CV47 2DF (GB); Jane Steenstra, 20 Ladbroke Hall, Ladbroke, Leemington Spa CV47 2DF (GB)

( * ) Notice: Subject to any disclaimer, the term of this patent is extended or adjusted under 35 U.S.C. 154(b) by 111 days.

(21) Appl. No.: 10/381,505

(22) PCT Filed: Oct. 2, 2001

(86) PCT No.: PCT/GB01/04388

§ 371 (c)(1),
(2), (4) Date: Mar. 25, 2003

(87) PCT Pub. No.: WO02/28497

PCT Pub. Date: Apr. 11, 2002

(65) Prior Publication Data

US 2005/0258594 A1 Nov. 24, 2005

(30) Foreign Application Priority Data

Oct. 2, 2000 (GB) ..... 0024040.8

(51) Int. Cl.
*A63F 3/00* (2006.01)

(52) U.S. Cl. ..... 273/236; 273/276

(58) Field of Classification Search ..... 273/236, 273/276; 446/124, 125
See application file for complete search history.

(56) References Cited

U.S. PATENT DOCUMENTS

| | | | | |
|---|---|---|---|---|
| 3,547,444 | A * | 12/1970 | Williams et al. | 273/294 |
| 4,416,454 | A | 11/1983 | Delamontagne | |
| 4,643,427 | A | 2/1987 | Wozniak | |
| 5,415,413 | A | 5/1995 | Morinich | |
| 5,772,207 | A | 6/1998 | Cascila | |
| 5,993,282 | A | 11/1999 | Ernst | |
| 6,270,077 | B1 * | 8/2001 | Cohen | 273/273 |

FOREIGN PATENT DOCUMENTS

EP 0382 369 A2 1/1990

* cited by examiner

*Primary Examiner*—Vishu K. Mendiratta
(74) *Attorney, Agent, or Firm*—Donald N. MacIntosh

(57) ABSTRACT

A multi-phase analytical game activity, is prefaced with a construction phase, in which are constructed from component elements, a plurality of [co-operatively-disposed] playing pieces (11), such as hollow, co-operatively inter-nesting cubes; with coded marking of individual facets (15), according to designated topics and subsidiary categories; whereby cube and facet juxtaposition reflect topic inter-relationships and hierarchies; in a follow-on board game phase, progress around a designated playing area is determined by random chance selector means, and coding of placement areas triggers selection of topic query cards for topic exploration.

4 Claims, 26 Drawing Sheets

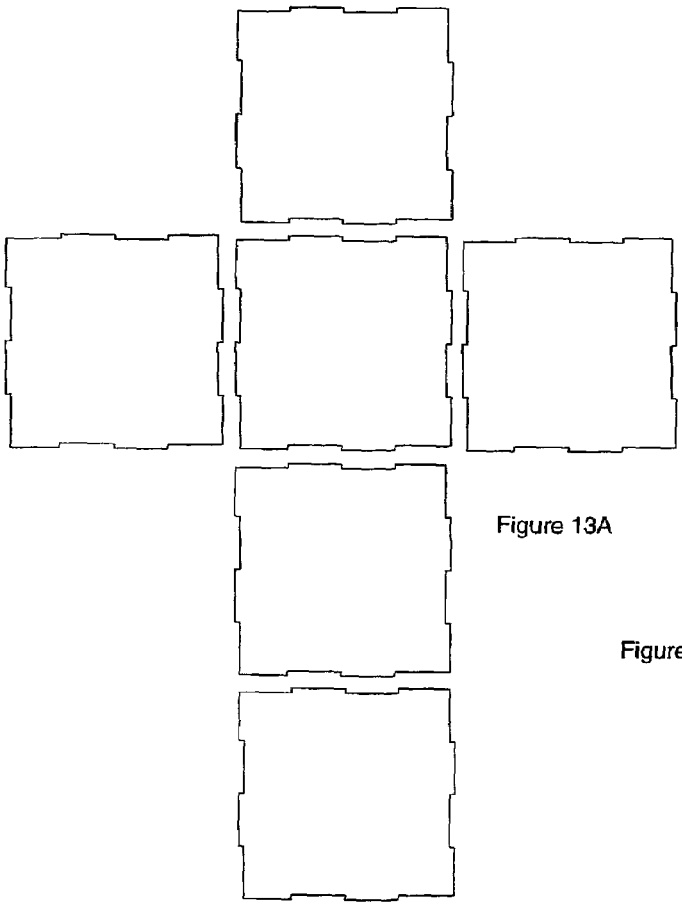
Figure 13A
Figure 13B
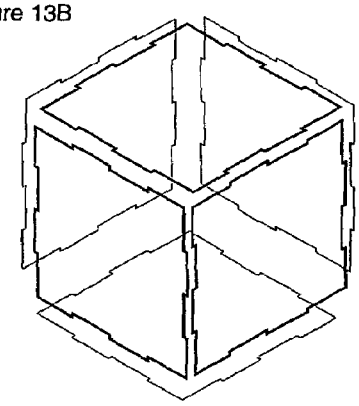
Figure 13C
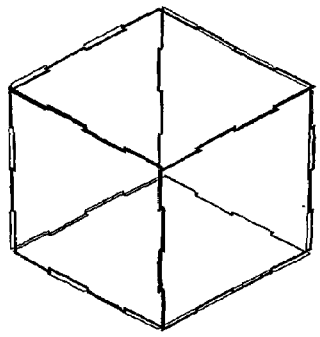

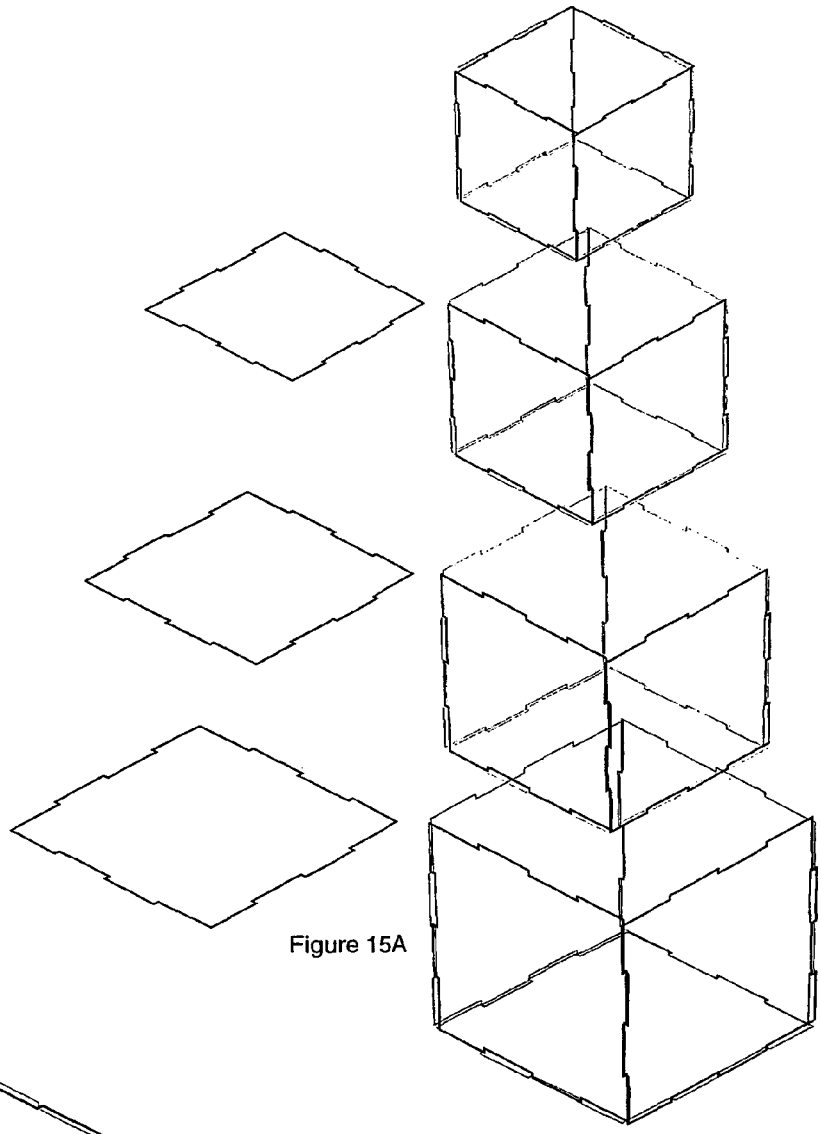
Figure 15A
Figure 15B
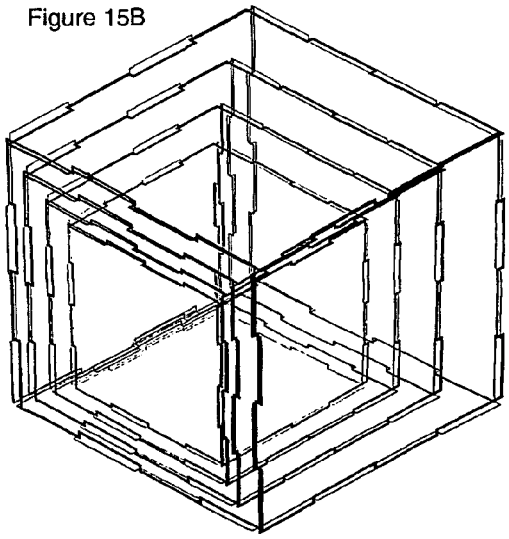

| | |
|---|---|
| Q | A change in legislation has resulted in the increase in cost of a raw material. How will you manage with existing resources? |
| | Cut price (by a safe margin) to increase sales. |
| | Increase efficiency in collecting residues to cover costs. |
| | Use in-house company knowledge and expertise for problem solving. |
| | Employ cost-effective technology. |
| X | |

Figure 35A

| | |
|---|---|
| Q | New developments in technology have rendered your product outdated. What do you do? |
| | Re-examine and redefine your company vision. |
| | Identify vendors/partners that will bridge the gap. |
| | Develop contingency plans for the future. |
| | Update your core technology. |
| X | |

Figure 35B

| | |
|---|---|
| Q | New technologies provide the opportunity to expand your product range. What steps do you take? |
| | Redefine your brand strategy to accomodate the new product line. |
| | Allocate business resources for these new activities. |
| | Create NPD teams. |
| | Develop portfolio plans to take advantage of the new technology. |
| X | |

Figure 35C

| | |
|---|---|
| Q | A particular shortcoming in your product is being used by your competitors to their advantage. What will you do? |
| | Identify technology requirements to create new features. |
| | Influence consumer perceptions to downplay the shortcomings. |
| | Redefine your business strategy to give more importance to benchmarking. |
| | Redefine your product specifications. |
| X | |

Figure 35D

| | |
|---|---|
| Q | Your products are being imitated in markets where you have no reach. What do you do? |
| | Establish suppliers in those new markets. |
| | Redefine your brand strategy to emphasise the uniqueness of your product. |
| | Redefine your Input/Output process to make imitation difficult. |
| | Employ a particular technology to differentiate your product on the basis of its superior quality of manufacturing. |
| X | |

Figure 35E

| | |
|---|---|
| Q | **There is a strike in your factory during a boom in demand for your product. What will you do?** |
| | Develop plans/strategies for similar situations in the future. |
| | Divert business resources to solve this problem in the short run. |
| | Use your leadership qualities to resolve the situation. |
| | Maintain and develop your core technology to handle increased production. |
| X | |

Figure 36A

| | |
|---|---|
| Q | **You are entering a new market. How will you compete with well established brands?** |
| | Allocate resources towards the new venture. |
| | Streamline the input/output process to accomodate additional production. |
| | Study potential consumers to get an insight. |
| | Communicate the USPs of your product to consumers. |
| X | |

Figure 36B

| | |
|---|---|
| Q | **Consumer feedback calls for changes in your product. What steps do you take?** |
| | Develop a new product with the required features. |
| | Identify the specific technology to meet these changes. |
| | Redefine your business strategy to meet consumer needs on a regular basis. |
| | Invest in developing consumer insights to prepare for similar future scenarios. |
| X | |

Figure 36C

| | |
|---|---|
| Q | **Your customers demand certain products/ services not currently provided. Competitors may monopolise this segment. What do you do?** |
| | Invest in developing consumer insights to prepare for similar future scenarios. |
| | Remain focused on existing product range and identify vendors to develop these products for you to resell. |
| | Look at existing contingency plans for a strategy. |
| | Using your existing technology platform, expand your product range. |
| X | |

Figure 36D

| | |
|---|---|
| Q | **There is a growing trend towards eco-friendliness, not just in law-making bodies, but also in consumers. What will you do?** |
| | Employ specific technlogies to make these changes. |
| | Change your Input/Output process to be more flexible towards this trend. |
| | Alter your design criteria in this context. |
| | Redefine your brand values. |
| X | |

Figure 36E

| Q | Your competitors have an edge over you in terms of their pricing. What will you do? |
|---|---|
| | Capitalise on the superior quality of your product to increase sales. |
| | Select one competitor and make him a partner. |
| | Strengthen your distribution network. |
| | Innovate better products using your existing technology. |
| X | |

Figure 37A

| Q | Demand for your product is growing, accompanied by the need for greater variety. What do you do? |
|---|---|
| | Create NPD teams. |
| | Redefine your brand strategy to accomodate the new line of products. |
| | Allocate business resources towards R&D. |
| | Study what competitors are providing. |
| X | |

Figure 37B

| Q | Changing trends call for redefining your brand image. What steps will you take? |
|---|---|
| | Redefine your business strategy to accomodate such changes in future. |
| | List down new product specifications to complement the brand image. |
| | Staffing - hire professionals for this activity. |
| | Identify technology requirements to stay up-to-date. |
| X | |

Figure 37C

| Q | There is an unexpected boom in demand for your products. How do you meet deadlines? |
|---|---|
| | Increase efficiency of your human resources. |
| | Improve your product management. |
| | Examine your business needs in this context. |
| | Upgrade your technology to meet higher levels of production. |
| X | |

Figure 37D

| Q | Product Failure resulted in a litigation. What do you do? |
|---|---|
| | Re-examine your work culture to motivate employees to work harder and produce better results. |
| | Upgradate technology. |
| | Redefine your product specifications. |
| | Recreate your brand promise. |
| X | |

Figure 37E

| Q | In order to be seen as the market leader, you want to bring about trends. What steps will you take? |
|---|---|
| | Develop and show prototypes. |
| | Chalk out a strategy to prepare your consumers. |
| | Channelise business resources into innovation. |
| | Use your brand promise to create confidence in your consumers about your new products. |
| X | |

Figure 38A

| Q | One of the divisions in your company has unprofitable for some time. How will you manage it? |
|---|---|
| | Build on your core technology to make better products. |
| | Plan a new portfolio for this division. |
| | Make it work in co-dependence with a healthy division. |
| | Use the existing knowledge and expertise within the company to focus on this problem. |
| X | |

Figure 38B

| Q | There is an increased number of competitors. How do you maintain brand loyalty? |
|---|---|
| | Ensure your technology vision is up-to-date. |
| | Plan your portfolio to keep up with competition. |
| | Use your understanding of the market to meet consumer needs. |
| | Use the credibility of your product to reaffirm your status. |
| X | |

Figure 38C

| Q | You want to enter a new market segment with the same product. What steps will you take? |
|---|---|
| | Develop a new product strategy for that segment. |
| | Study the competition in that segment. |
| | Examine the consumer needs for that segment. |
| | Allocate business resources for this new venture. |
| X | |

Figure 38D

| Q | Your brand image is deteriorating. What steps do you take to overcome this? |
|---|---|
| | Study your customers closely to understand them better. |
| | Work out a strategy to recreate your product's credibility. |
| | Examine your Input/Output process closely for any inconsistencies. |
| | Re-examine your technology to keep it up-to-date. |
| X | |

Figure 38E

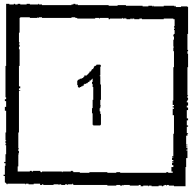

Figure 39A

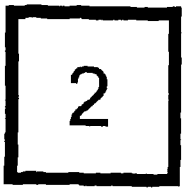

Figure 39B

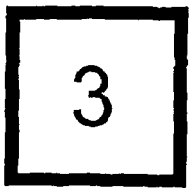

Figure 39C

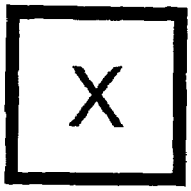

Figure 39D

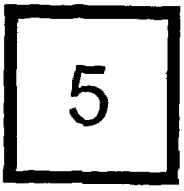

Figure 39E

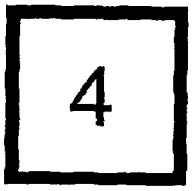

Figure 39F

| | Input | Strategy | Process | Enablers | People | Output |
|---|---|---|---|---|---|---|
| Business | | | | | | |
| Brand | | | | | | |
| Platform | | | | | | |
| Product | | | | | | |

Figure 42

| | Action | Importance | Date | Responsibility | |
|---|---|---|---|---|---|
| BUSINESS | | | | | |
| Inputs | | | | | |
| | | | | | |
| Strategies | | | | | |
| | | | | | |

Figure 43

| | Risk | Description | Likelihood | Impact | Action | Respon. |
|---|---|---|---|---|---|---|
| BUSINESS | | | | | | |
| Inputs | | | | | | |
| | | | | | | |
| Strategies | | | | | | |
| | | | | | | |

Figure 44

| | | LEVEL | | | |
|---|---|---|---|---|---|
| | | Business | Brand | Platform | Product |
| FACTOR | Strategies | Company Vision | Brand Vision | Commonality Vision | Product Strategy |
| | Processes | Business Processes | Brand Positioning | Portfolio Planning | NPD Processes |
| | People | Culture | Consumer Needs | Consumer Perception | NPD teams |
| | Enablers | Technology Vision | Capability | Common Technology | Core Technology |
| | Inputs | Competition / Technology / Suppliers / Distribution / Regulation / Environment | | | |
| | Outputs | Profit | Loyalty | Efficiency | Satisfaction |

Figure 45

[MANAGEMENT TRAINING] GAME ACTIVITY

BACKGROUND OF THE INVENTION

Context

This invention relates variously to education and training activities, media, material, games, toys and playthings. A whole gamut of [game] activities have been devised as dedicated educational, teaching, training, coaching, learning, recreational and therapeutic tools. Thus, a game activity can create and engender a favourable climate and rationale for conveying topic information 'subliminally', and 'in context'.

A game activity can be used to gain analytical and decision-making skills and experience, through exercises or simulations of commercial situations—but without the [financial] risks and consequences attendant real-life action. Thus game activity can be a rehearsal for a real situation. A game activity structure can contrive individual involvement and participative immersion, jointly and co-operatively with others in a team. Ideas, inspiration and motivation can be 'cross-fertilised' through challenging sessions. On occasion, a game activity can prove as, if not more, effective than formal study, through group classroom lecture session or individual (book) study.

Supervision

A game activity may include specific provision for supervision—by players themselves and/or a moderator or facilitator. This is for adherence to game activity rules, resolution of queries on rule interpretation, arbitration upon disputes and to enforce general player behaviour and discipline, marking or adjudicating a final outcome.

Learning & Recreation

In principle, game activities generally can be categorised as combining learning and recreation. Even a military exercise, or war game activity, shares an element of fulfilment, to a (constructive) purpose, through personal participation and group or team membership to a common end.

Game activities may be tailored to particular age groups, or interests, and may evoke 'real-life' situations, such as sports or (property) trading and acquisition. Some degree of skill, knowledge, awareness, pre-disposition and assumption testing may also be required.

Management Training

A particular game activity category is dedicated to what might loosely be categorised as management training. Management game activities commonly seek to simulate, emulate, or model aspects of business, trade or commerce or organisation of business tasks. Commonly, this involves individual and collective (i.e. through team building) role playing, in a prescribed scenario, with a framework of rules and towards a defined of all objective. For example, by modelling fluctuating market conditions and simulating production and trading transactions, players can learn, from the experience of first-hand involvement, outcomes of personal or team decisions. A supervisor or moderator can help draw general and overall conclusions upon business strategies and tactics, from a particular game activity experience.

Complexity

Game activity is more widely applicable to complexity management, discussed later.

Alignment

In particular, game activity can help identify and align perceptions and decision factors, particularly with a complex interplay of factors.

Terminology

Play

The term play embraces recreation and learning. Play allows exercise of a natural blend of creative, intellectual, co-ordination and manipulative skills. Similarly, player, denotes an individuals engaged in play.

Game Activity

The expression or phrase game activity is used herein generally to embrace a structured context and participatory [conceptual] delivery vehicle, involving one or more playing pieces or elements. Playing pieces are movable—typically over a playing [surface] area—in accordance with prescribed rules. Again, those engaged in game activity are players or participants. In the broadest sense, game activity participants, or players, and indeed even onlookers (insofar as they engender a climate or backdrop, and relay encouragement or otherwise), can themselves can be regarded as playing pieces.

Tools & Toolset

Game activity constituent elements can be regarded individually as tools, and collectively as a toolset. A game activity may incorporate (disparate) other elements, such as tokens, or differentiated playing pieces. A random chance generator, such as a dice throw, can be used to trigger unexpected events, obstacles, and/or the progression of play.

Toy

The term toy embraces any structure or kit for assembly and used in a play context.

Rules

Rules may prescribe an overall game activity regime, purpose or objective and some ranking or scoring schedule for individual players. Progression through successive game activity steps or sequences and the order of participation of multiple players can be enshrined by a set of game activity rules. Game activities may be played solo or collectively, between individual players or teams of players.

BRIEF SUMMARY OF THE INVENTION

Statements of the Invention

According to the invention, an analytical construction game, is configured for analysis of a designated topic, the game comprising a plurality of multi-facet game activity playing elements, with one or more (polygonal) facets, allocated to respective topics, by respective coded marking, and configured, such as through complementary form, for co-operative mutual juxtaposition, with other (such) elements, whereby to present an alignment of topics, for player consideration and interpretation.

According to another aspect, an analytical construction game, is configured for analysis of a designated topic, the game comprising a plurality of multi-facet game activity playing elements, configured as hollow 3-D polygonal structures, with one or more (polygonal) facets, allocated to respective topics, and subsidiary topic categories, by respective coded marking, and configured, such as through complementary form, for co-operative mutual juxtaposition, and internesting, with other (such) structures and associated facets, whereby to present, through visual symbolism, an alignment of topics and categories, and an attendant inter-relationship there between, for player consideration and interpretation, towards topic analysis.

According to a further aspect, an analytical board game, for use in conjunction with the analytical construction game, comprising a playing area, with a plurality of [colour] coded placement areas, for a playing piece, allotted to game participant; the colour coding representing a designated topic, and associated subsidiary topic categories; certain placement areas being configured in a prescribed incremental route; other placement areas being configured in a positioning matrix or grid; there being further provided collections of question cards, with selective alternative multiple choice answers, of corresponding colour coding to the placement areas; the game rules providing that playing piece progress, around the playing area route, is determined by random chance selector means, such as a dice throw; and the placement area (colour) code occupied by a playing piece, determines allocation of a topic question cards, selected from a similarly (colour) coded stack; and presenting the player with a topic question, and multiple alternative response choices; the question card being placed back upon the positioning grid, at a coded position reflecting a player selected response; whereby, as the game progresses, cards accumulated upon the grid, reflect past player decisions, and any player pre-disposition to certain topics.

According to yet another aspect, a multi-phase [analytical] game activity, [utilising elements signifying designated topics, for analysis of contributory factors,] has a construction phase, comprising the steps of constructing, from a plurality of constituent elements, a plurality of hollow, 3-D structures; the elements being individually coded, say, by markings, symbols, insignia, colour, pattern or texture, to represent an association or grouping, with a corresponding 3-D structure; the structures being allocated respective topics, and facets of the structures being allotted subsidiary topic categories; the structures being configured and scaled for relative interfit, and the preliminary phase being concluded, upon assembly of a set of mutually nternesting structures; the assembly symbolising, visually to game participants, a hierarchical topic and category inter-relationship, [and allowing an interpretation thereof];

a board game phase, allowing re-consideration of construction elements, and attendant marking, in the context of a board game; in which playing pieces move incrementally, between successive placement areas, around a prescribed route upon a playing area; the placement areas being coded, in conformity with the construction element coding; and the game rules providing for incremental progression between placement areas, along a prescribed route, by successive increments, determined by random chance selector means; a participant player allotted that piece taking a correspondingly coded card, presenting multiple choice considerations, or situational criteria, for consideration and selection; the card being returned to an allocation grid, categorising player response to the presented choice, whereby, as the game progresses, accumulation of cards deposited by players reflects their overall approach to card content.

Facets may comprise discrete elements, with opposed face markings, accorded a particular (differentiated) significance. These facets may be orientated inward or outward, in a 3-D assembly, albeit of 2-D constituent [panel] elements, with consequent impact upon the overall appearance. Thus translucent facets allow shared viewing of inner and outer face markings.

Optionally, one or more individual facets are sub-divided. A sub-division example would be a (regular) matrix, or grid array—of juxtaposed areas or sections. These sections could in turn represent respective subsidiary categories, or contributory factors. A rectangular facet profile—in particular, (uniform) square facets, combining to form a cube structure—is a convenient content layout format.

Multiple playing elements may be configured mutually to internest. Thus, a set of playing pieces may comprise relatively scaled or sized internesting cubes. Individual cubes could then be hollow, with, say, an open or (re)movable facet.

Pre-Fabricated

A pre-fabricated playing pieces structure could be employed. Thus, for example, a hollow 3-D form could be assembled from a unitary, cut and folded, 2-D flat sheet (carton blank). Alternatively, multiple discrete elements, such as constituting some part or all of a playing piece facet, could be (inter-) assembled. A co-operative interlocking edge profile could be used for such inter-assembly.

Internesting symbolises the hierarchical inter-relationship of information or data factors—as indeed does the assembly of playing pieces from component parts.

Modification

The game activity rules could encompass modification, adaptation or extension of playing pieces—or indeed the rules themselves. Commitment of game activity participants to the game activity purpose and allegiance to—or indeed perceived 'ownership' of—game activity outcome can thereby be reinforced. Indeed, a target outcome or benefit itself could be subject to player input.

Game Activity Element(s)—Playing Pieces (Self) Marking

In some variants, provision may be made for a game activity participant, or player, (physically) to mark a facet—or facet sub-division—say with specific indicia, signs, symbols, markings, graphics or text, representing data upon a game activity being played.

3-D Polygon

Conveniently, the element structure is configured as a 3-D polygonal form. Whilst, in principle, a diversity of forms may be employed, a cube is a particular preferred format. The regularity, (mirror) symmetry, simplicity and rectangularity of a cube simplify construction, marking, facet layout or sub-division—and use.

Nevertheless other polygonal forms, such as pyramids, tetrahedrons, octahedrons, etc could be used. Whilst straight-edged, or straight-sided, structures offer constructional simplicity, and ease of interfit, curved-sided forms are conceivable.

Multiple Playing Pieces

A plurality of multi-faceted structures—whether cubes or otherwise—could be employed. The relative disposition and orientation of juxta-posed playing pieces, and or some co-operative interaction could have some significance in the broader game activity context.

Thus, for example, successive juxta-posed playing pieces, with their respective faces (differentially) aligned, could be used to present prescribed combinations of information. Selective alignment of playing element facets with a playing surface area, or designated portions, segments, sectors, or placement areas, can also feature in the game activity 'schema'.

Business Facets

In practice, playing pieces could impart key aspects, elements, or considerations of business (e.g. innovation) strategy, such as:

organisation or business
brand(ing)
portfolio (e.g. assets)
product(s) {services}

These have both an individual (self-contained) significance or meaning, and a collective (e.g. hierarchical) (inter) relationship, or mutual (inter)dependency.

Moreover, individual facets of pieces allow concept subdivision, and the facets themselves could be further subdivided—such as in rows, or columns—into subsidiary topics, including:

inputs (internal & external stimuli)
strategies
people (internal human resources)
processes
technology
output(s)

Pre-Fabricated

As indicated, a particular game activity element, or playing piece structure, may embody a pre-fabricated template—say, as a self-assembly or self-erect kit. Thus, say, a 2-D 'carton blank', of (flat) sheet material, with a (die.-cut) outline profile may be prised from the body of the sheet, as a 2-D (subsidiary) panel, and converted (by folding) into a 3-D form. In somewhat more advanced versions of the game activity, an outline profile is conveniently pre-cut, scribed or perforated, such as by a die. cutter blade.

Alternatively, the outline may be partly or wholly predefined, by marking, cutting, scoring or perforation, upon an otherwise contiguous sheet, as a reference line or path—about which to 'prise' a (panel) element from the body of the sheet. Such a sheet could be (initially) flat—so that the or each severed panel element would also be (initially) flat.

Surface Contour

Alternatively, the sheet could embody a pronounced surface contour, such as (arcuate) curvature, sinuous, stepped or corrugated form—so that the derived elements embodied a similar contour (pre-) disposition.

Whether flat or contoured, the outline may then be severed from entrainment with the sheet, by tearing along a designated (pre-perforation) line. An outline form may incorporate creases, score lines and folds, disposed to allow a 2-D panel element to be converted, by folding, into a 3-D erected form. Similarly, to this end, (interlocking) slots and locating tabs may be incorporated into the outline form, to preserve the 3-D erect structure.

Mask

A lattice structure, graticule, framework could be devised as a master mask or canvas—from which a particular game activity element could be derived, such as by selective sub-profiling, severing and separation. (Micro) perforations or a frangible web could accommodate disparate shapes and sizes—if necessary with a design of a player's choosing.

A plurality of discrete game activity elements—of similar or disparate form—could be incorporated (in co-operative disposition) upon a common sheet, for (independent) mutual severance and separation. The outline marking(s) could allow (alternative) variant forms, affording a choice of path(s) to follow in order to prise a chosen panel profile from the sheet.

Relative (Playing Piece) Disposition

As indicated, relative juxtaposition of individual elements, their respective faces or facets, and attendant markings or insignia may feature in the game activity rules.

BRIEF DESCRIPTION OF THE SEVERAL VIEWS OF THE DRAWINGS

There now follows a description of some particular embodiments of game activity and attendant tools and toolsets according to the invention, by way of example only, with reference to the accompanying diagrammatic and schematic drawings, in which:

FIGS. 1A through 15B reflect construction and disposition of 3-D structures as game activity tools; a particular consideration being translucent forms of FIGS. 11A through 15B FIGS. 1A through 1C show playing piece cube variants and an attendant playing area;

Figure 1A:
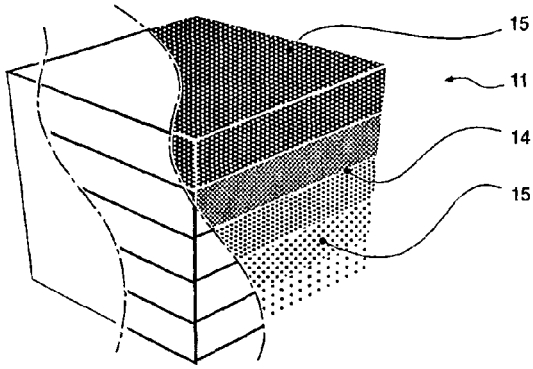
Figure 1B:
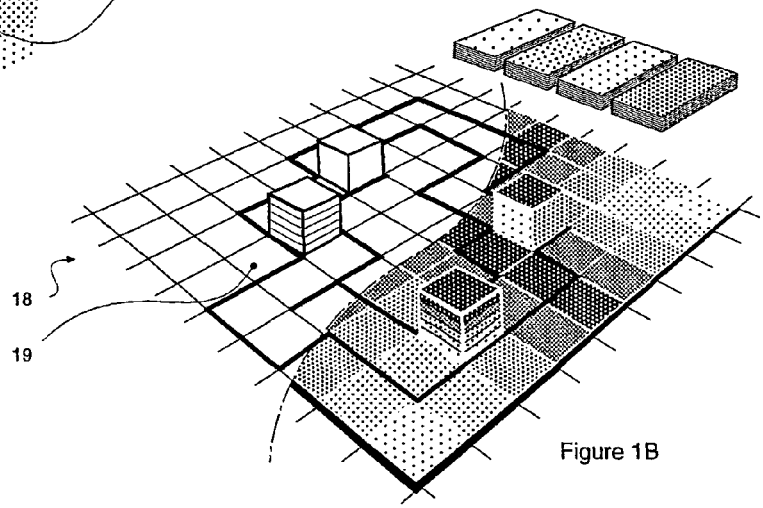
Figure 1C:
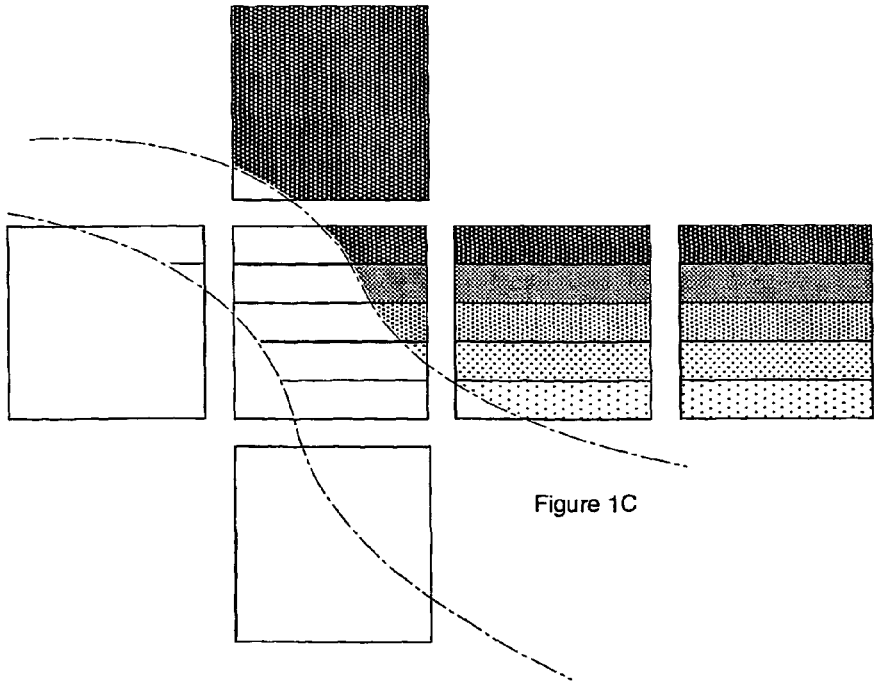
Figure 2A:
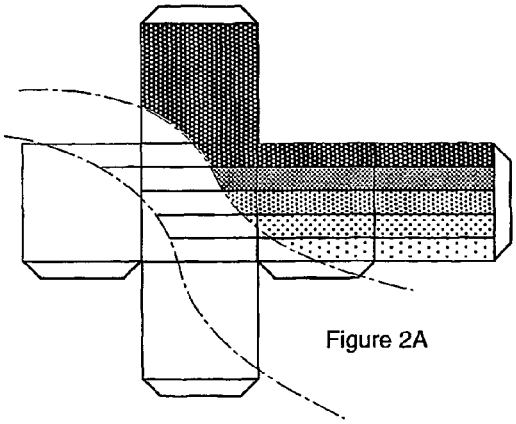
Figure 2B:
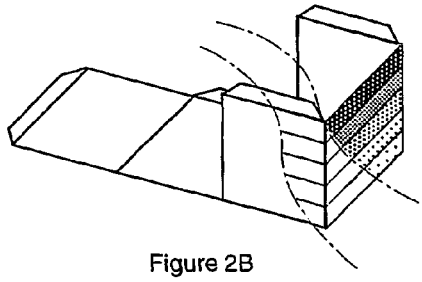
Figure 2C:
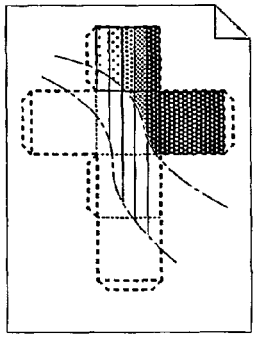
Figure 3A:
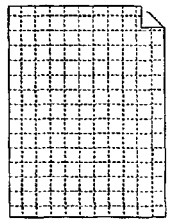
Figure 3B:
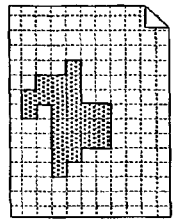
Figure 3C:
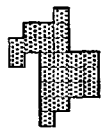
Figure 4A:
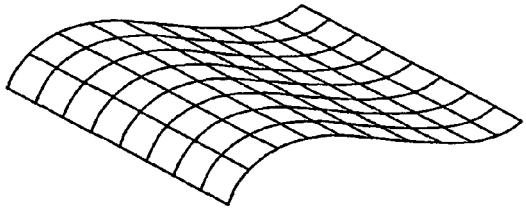
Figure 4B:
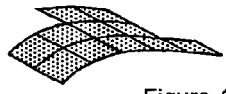
Figure 5A:
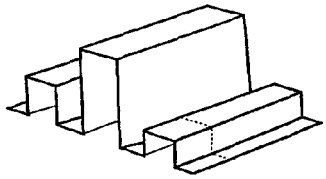
Figure 5B:
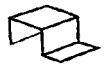
Figure 6:
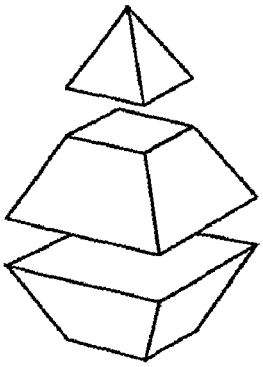
Figure 8:
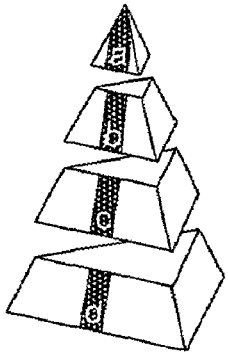
Figure 7:
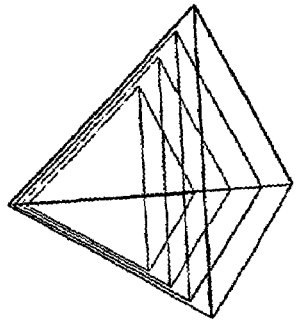
Figure 9:
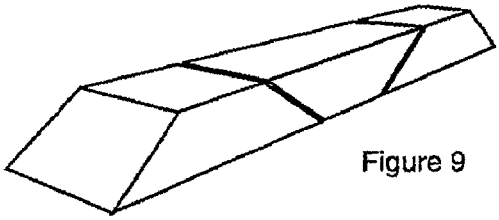
Figure 10:
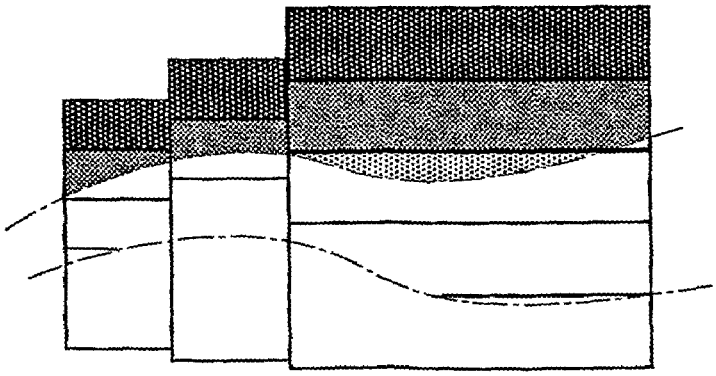
Figure 11A:
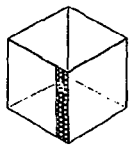
Figure 11B:
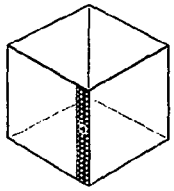
Figure 11C:
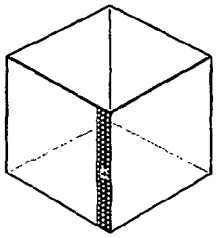
Figure 11D:
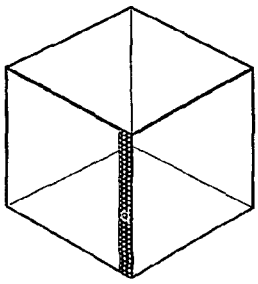
Figure 11E:
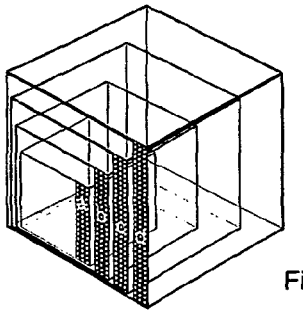
Figure 11F:
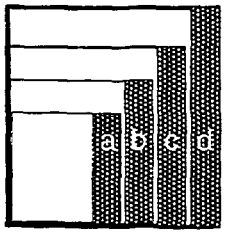

More specifically:

FIG. 1A shows a playing piece cube with various alternative facet treatments, from blank, through ruled, to selectively infilled, as a means of coded identification and differentiation; additional marking (not shown), such as symbols, legends, letters and w is may be employed;

FIG. 1B shows the disposition of the cube of FIG. 1A in the context of a board game; and in particular selective cube placement upon respective placement areas of a sub-divided board playing (surface) area, with corresponding coded treatment;

FIG. 1C shows the alternatives facet of FIG. 1A laid out in 2D map format;

FIGS. 2A through 2C show various erection stages of a 2-D carton blank format into a cube, again with indicative facet marking options;

More specifically:

FIG. 2A shows a 2-D carton blank, laid flat, ready for erection and assembly;

FIG. 2B shows the carton blank of FIG. 1A folded into a partially erected 3-D assembly form;

FIG. 2C shows derivation of the carton blank of FIG. 1A from a flat sheet;

FIGS. 3A through 3C show flexibility and variability of carton blank outline form derivation, from a (pre-perforated) master sheet;

More specifically:

FIG. 3A shows a 'blank canvas' pre-perforated master sheet;

FIG. 3B shows preparatory marking or in-fill of selected portions of the pre-perforated master sheet of FIG. 3A, to define a 2-D carton blank;

FIG. 3C shows a 2-D carton blank, derived from the designated marked area of the master sheet of FIG. 3B, ready for folding and assembly into a 3-D form—such as in the manner of FIG. 2B;

FIGS. 4A and 4B show derivation of a playing piece (carton blank) of 'contoured' surface profile, from a corresponding (pre-)contoured master sheet—optionally embodying the pre-perforation of FIGS. 3A through 3C;

More specifically:

FIG. 4A shows a pre-marked master sheet adopting a desired surface contour; FIG. 4B shows extraction of a carton blank element reflecting the local surface contour of the master sheet of FIG. 4A;

FIGS. 5A and 5B show derivation of a multiple folded (corrugated) playing piece (carton blank) from a (pre-) corrugated folded master sheet;

More specifically:

FIG. 5A shows a corrugated (i.e. stepped, alternating, reverse-folded) master sheet—again optionally embodying the pre-perforation of FIGS. 3A through 3C;

FIG. 5B shows a corrugated carton blank reflecting the local corrugated surface contour of the master sheet of FIG. 5A;

FIG. 6 shows an alternative 3-D structure to the cube form of FIGS. 1A through 2C, configured as playing piece of dual opposed truncated pyramidal 3-D form;

FIG. 7 shows a playing piece of fragmented, in particular slice-segmented, stacked juxtaposed pyramidal 3-D form;

FIG. 8 shows equilateral (internal-angled) multiple internested pyramidal forms, with co-operatively aligned facet marking indicia;

FIG. 9 shows mutually inter-fitting playing pieces, individually of trapezoidal-rhomboidal 3-D form;

FIG. 10 shows a progressively-sized hierarchy of cube sizes configured for mutual internesting—again with optional facet marking;

FIGS. 11A through 11F show a set of progressively different sized cubes with translucent walls, to allow—upon internesting—joint viewing of a data array of constituent data portions upon individual cube facets;

More specifically:

FIG. 11A shows a 3-D view of the smallest translucent walled hollow cube playing piece in a set of four, the three larger of which are shown in FIGS. 11B through 11D, with indicative markings on one facet for co-operative disposition with corresponding facet markings on the remaining cubes in the set, as shown collectively in FIGS. 11E and 11F; other marking layouts may be employed, such as a triangular 'label', with an apex at one cube corner and bounded by a corner to corner diagonal, as shown in FIG. 40.

FIG. 11B shows the next size increment in translucent walled hollow cube playing piece to that of FIG. 11A;

FIG. 11C shows the next size increment in translucent walled hollow cube playing piece to that of FIG. 11B; and FIG. 11D shows the largest sized translucent walled hollow cube playing piece in the set including the cubes of FIGS. 11A through 11C;

FIG. 11E shows a 3-D view of the cubes of FIGS. 11A through 11D internested and with their respective facet indicia 'correctly' aligned to convey desired cumulative or composite message; and FIG. 11F shows a 2-D side elevation of the internested cubes of FIG. 11E.

Figure 12A:
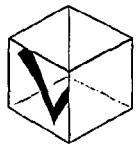
Figure 12B:
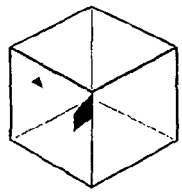
Figure 12C:
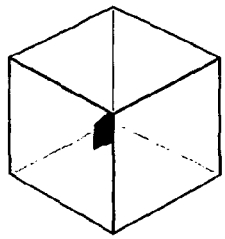
Figure 12D:
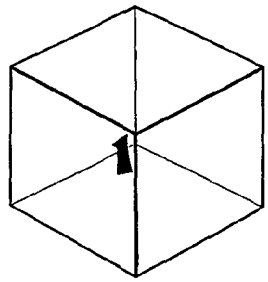
Figure 12E:
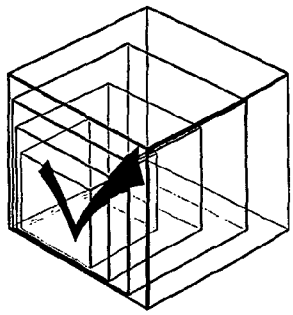
Figure 12F:
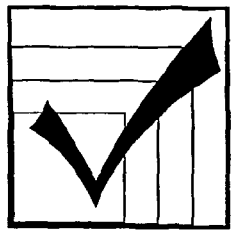
Figure 14A:
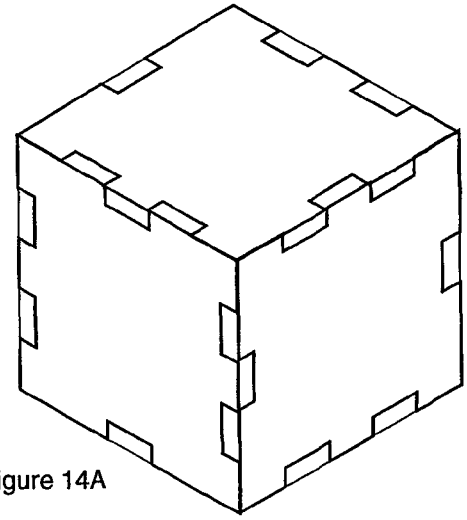
Figure 14B:
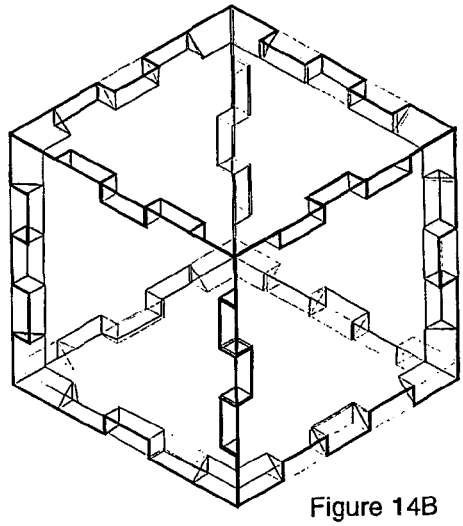
Figure 14C:
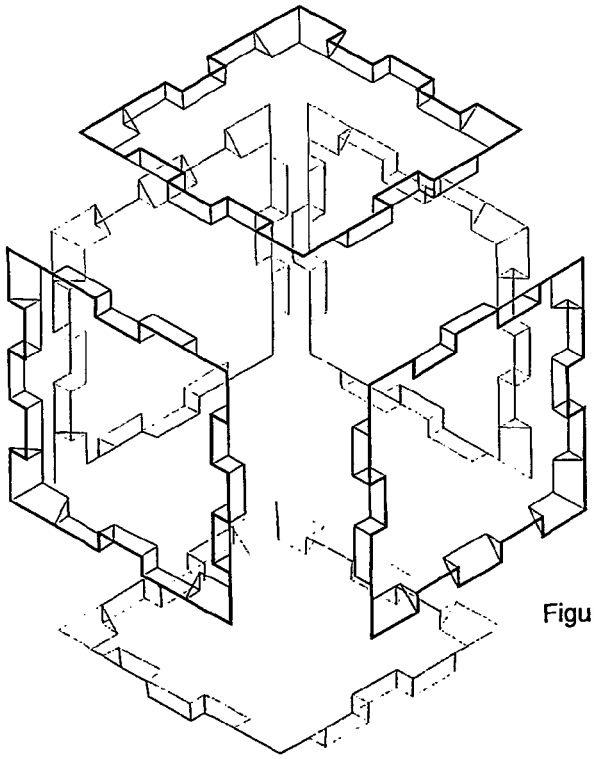
Figure 16:
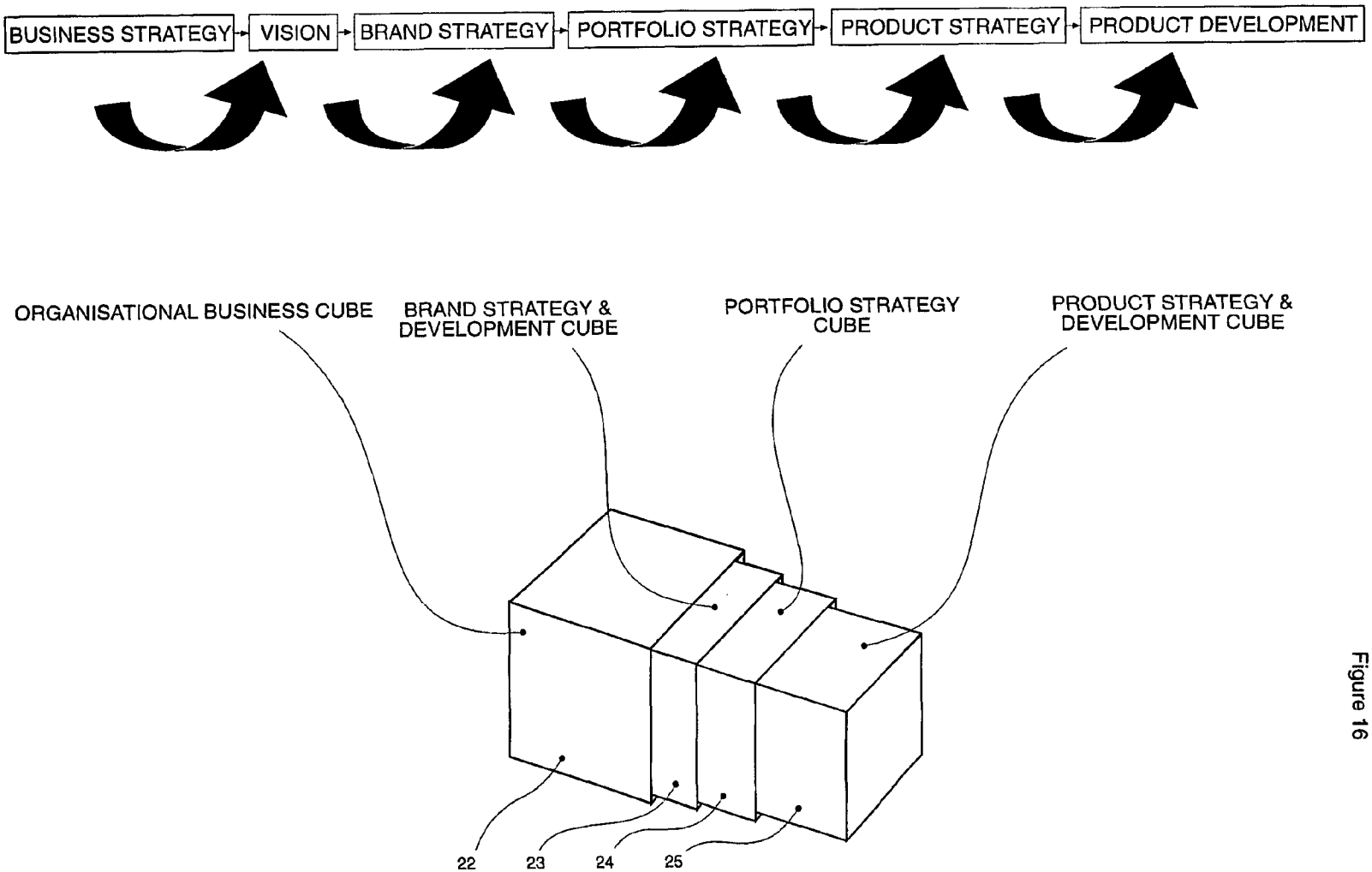

FIGS. 12A through 12F show a variant of the internesting translucent cube set of FIGS. 11A through 11F, with respective data fragments upon individual cube facets, collectively forming a coherent composite data set upon inter-assembly;

More specifically:

FIG. 12A shows another version of the translucent-walled hollow cube of FIG. 11A, with a fragmented facet marking, whose significance becomes progressively more evident as successive larger sized cubes, individually shown in FIGS. 12B through 12D, are internested—as depicted in FIGS. 12E and 12F;

FIG. 12B shows successive cube size increment, with associated facet marking indicia fragment;

FIG. 12C shows a third cube size;

FIG. 12D shows the largest cube size in a set of four, for co-operative internesting;

FIG. 12E shows four differentially-sized, internesting cubes of FIGS. 12A through 12D, in a particular facet juxtaposition to one common corner edge;

FIG. 12F shows a side elevation of the internested cube of FIG. 12E, with composite facet marking indicia;

FIGS. 13A through 13C show individual cube assembly from a 'kit' of component elements—in this case individual cube facets or sides, with co-operatively inter-fitting (jig-saw) edge profiles;

More specifically:

FIG. 13A shows a set of six individual panels, equivalent to cube facets, ready for inter-assembly;

FIG. 13B shows the facet panels of FIG. 13A juxtaposed in 3-D array, ready for inter-assembly;

FIG. 13C shows an assembled cube from the elements of FIGS. 13A and 13B;

FIGS. 14A through 14C show respectively a cube construction from chamfered edge constituent parts, in the manner of FIGS. 13A through 13C;

More specifically:

FIG. 14A shows a 3-D cube assembled from chamfered edge 2-D facets;

FIG. 14B shows a translucent variant of FIG. 14A, with respective aligned facet edge profiles interfitted;

FIG. 14C shows translucent facet panels of FIG. 14B juxtaposed in a 3-D array, ready for inter-assembly;

FIGS. 15A and 15B show progressive assembly and interfitting of translucent cubes, each constructed in the manner of FIGS. 13A through 13C, or FIGS. 14A through 14C;

More specifically:

FIG. 15A shows an 'exploded' view of four cube assemblies, with a face panel removed, to allow mutual internesting;

FIG. 15B shows the cubes of FIG. 15A internested;

FIG. 16 reflects the allocation of topic identities, features or roles to internesting cubes, such as of FIG. 15B to convey, in a game context, a relationship hierarchy; with a summary heading, i.e. from organisational (or business), through brand and portfolio to product strategies;

FIGS. 17 through 20 show specific facet layouts, and (colour, pattern, etc) coding, for individual game activity playing piece cubes, addressing FIG. 16 topics.

Figure 17:
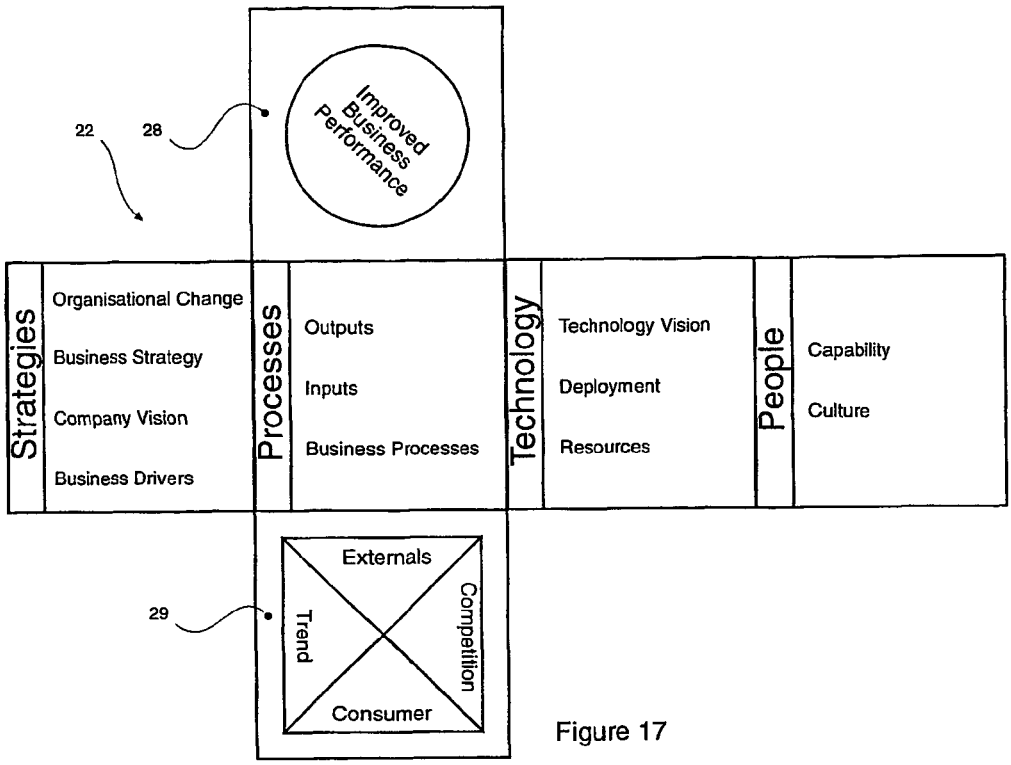
Figure 18:
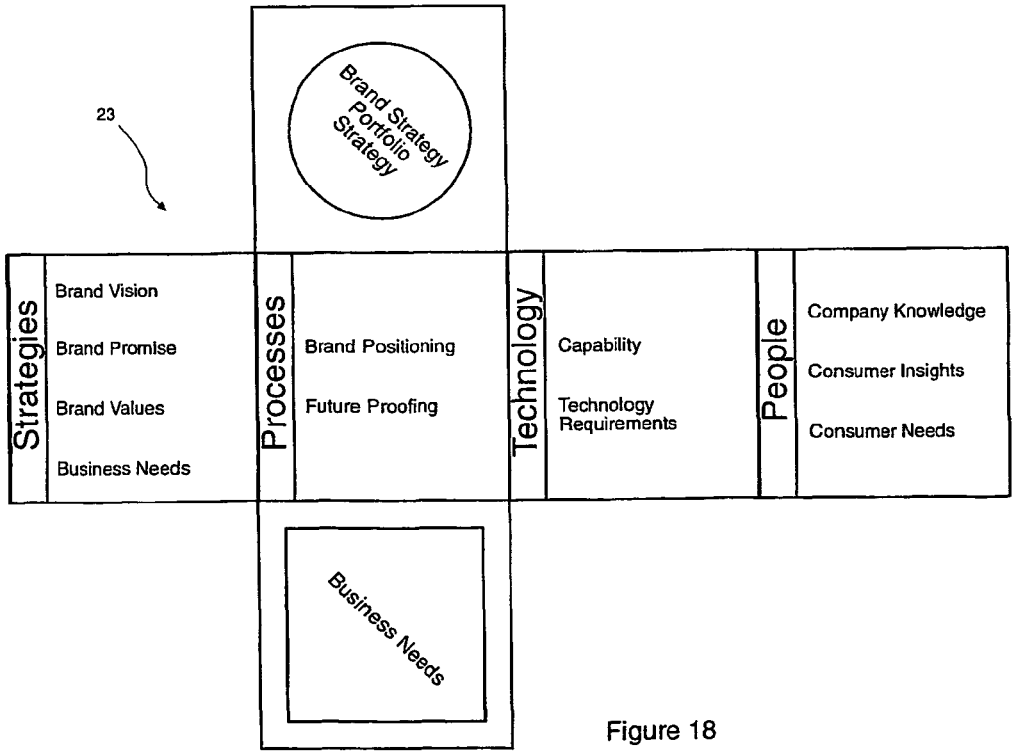
Figure 19:
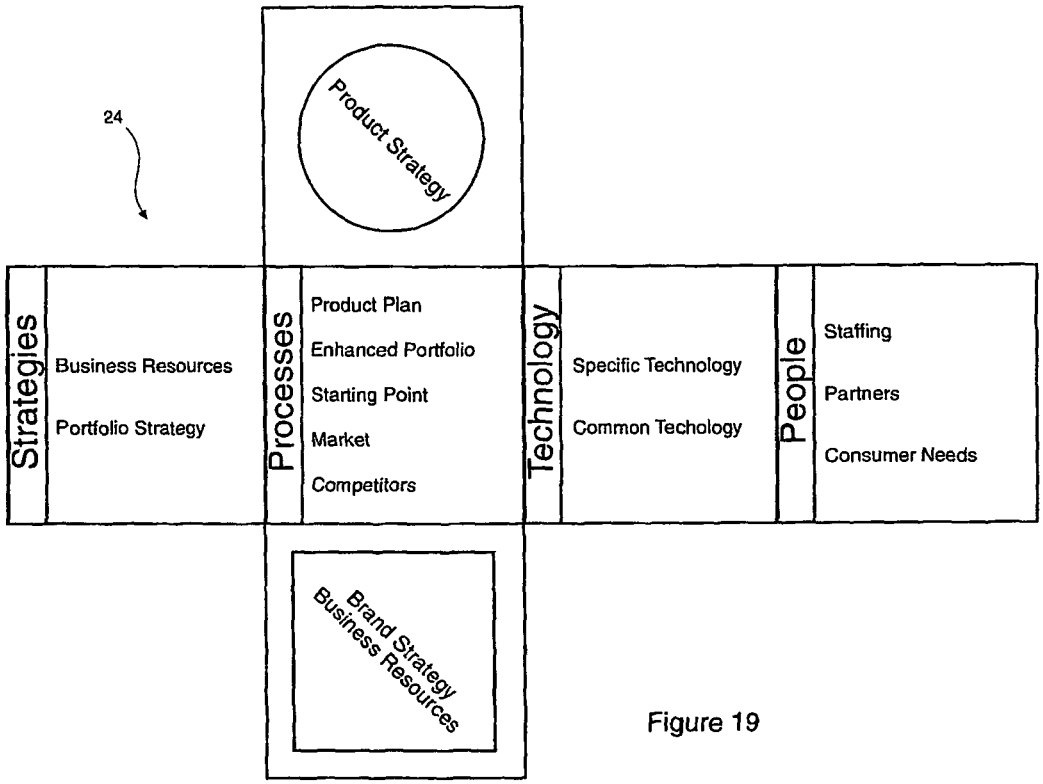
Figure 20:
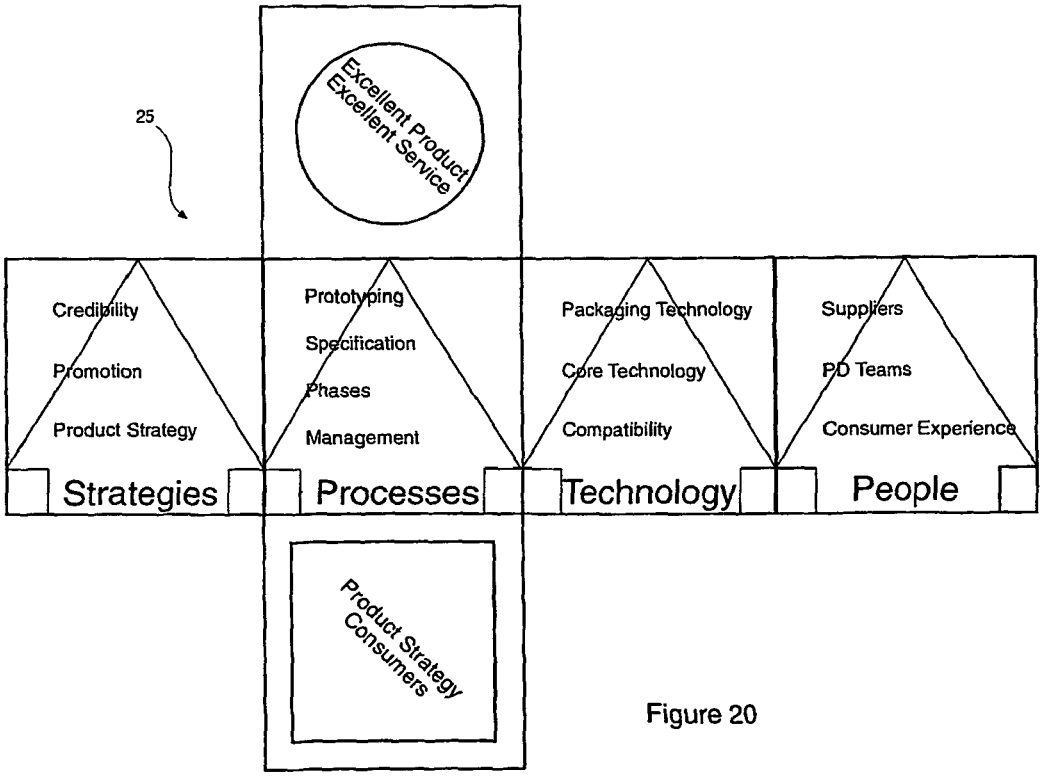
Figure 21:
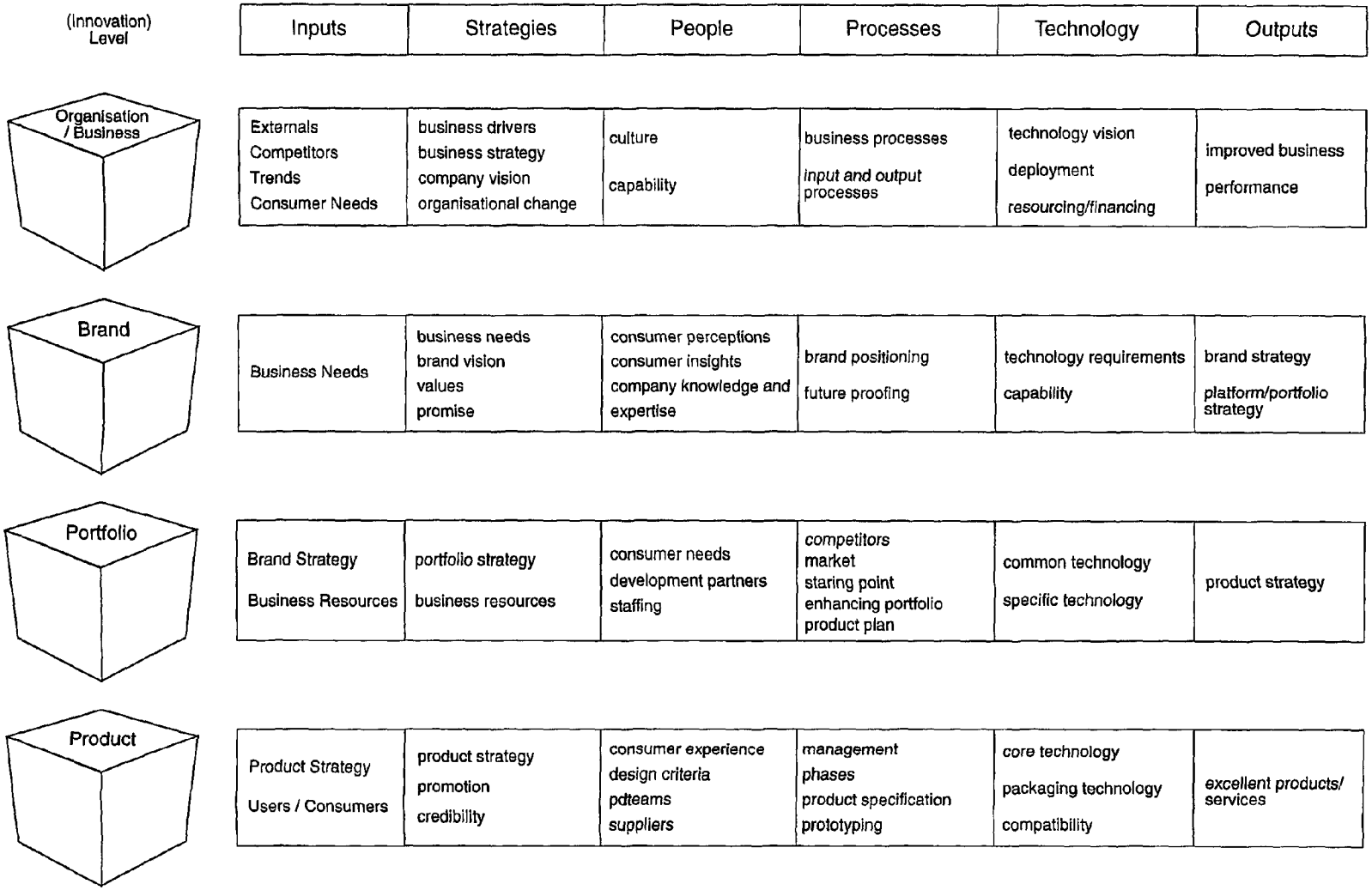
Figure 22:
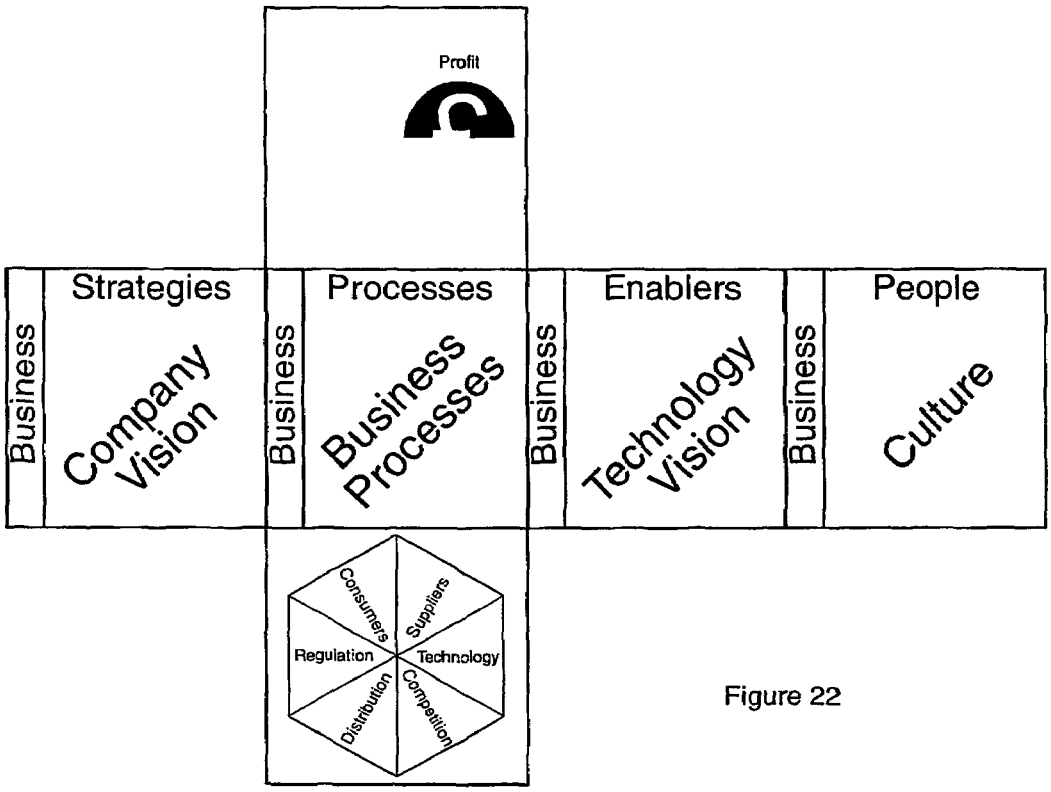
Figure 23:
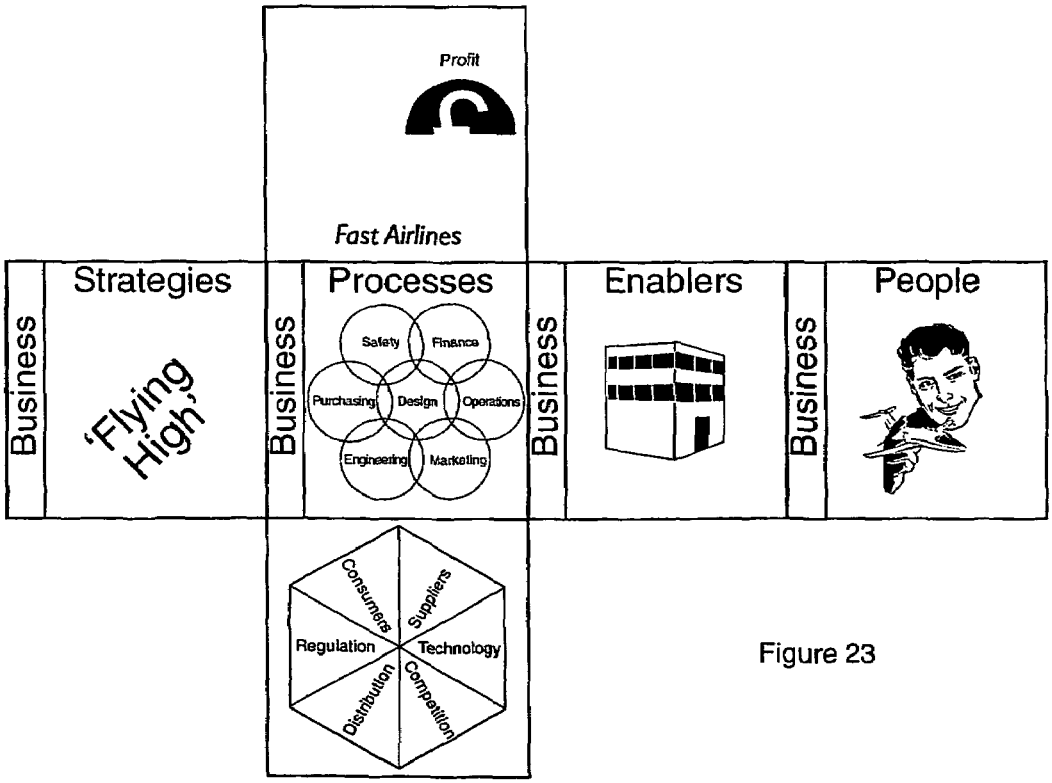
Figure 24:
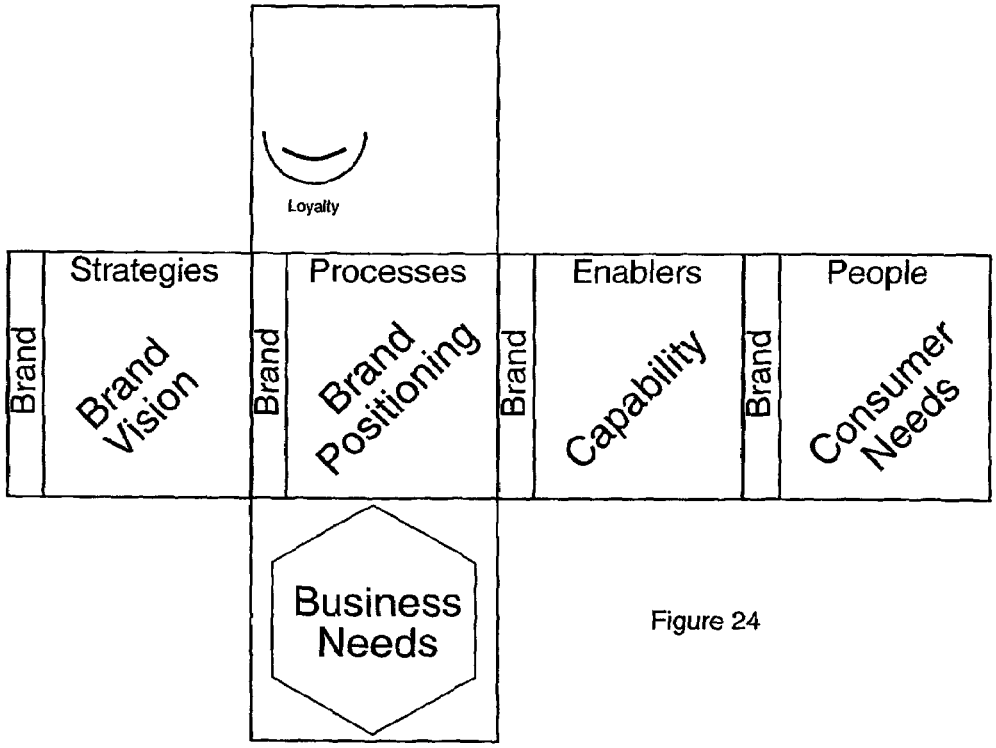
Figure 25:
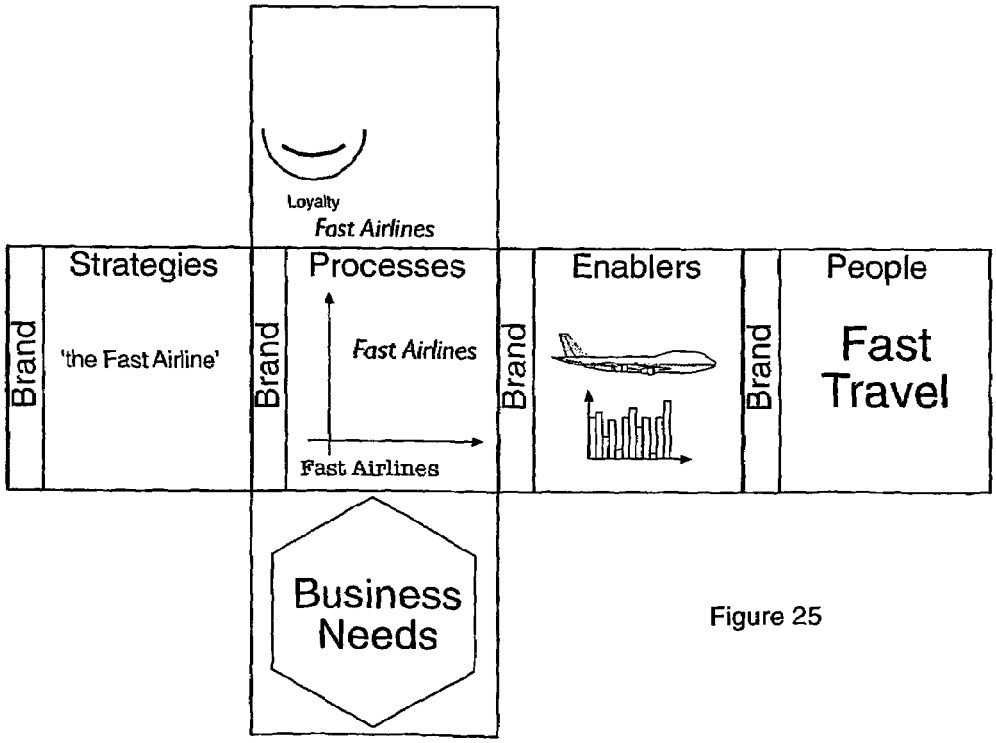
Figure 26:
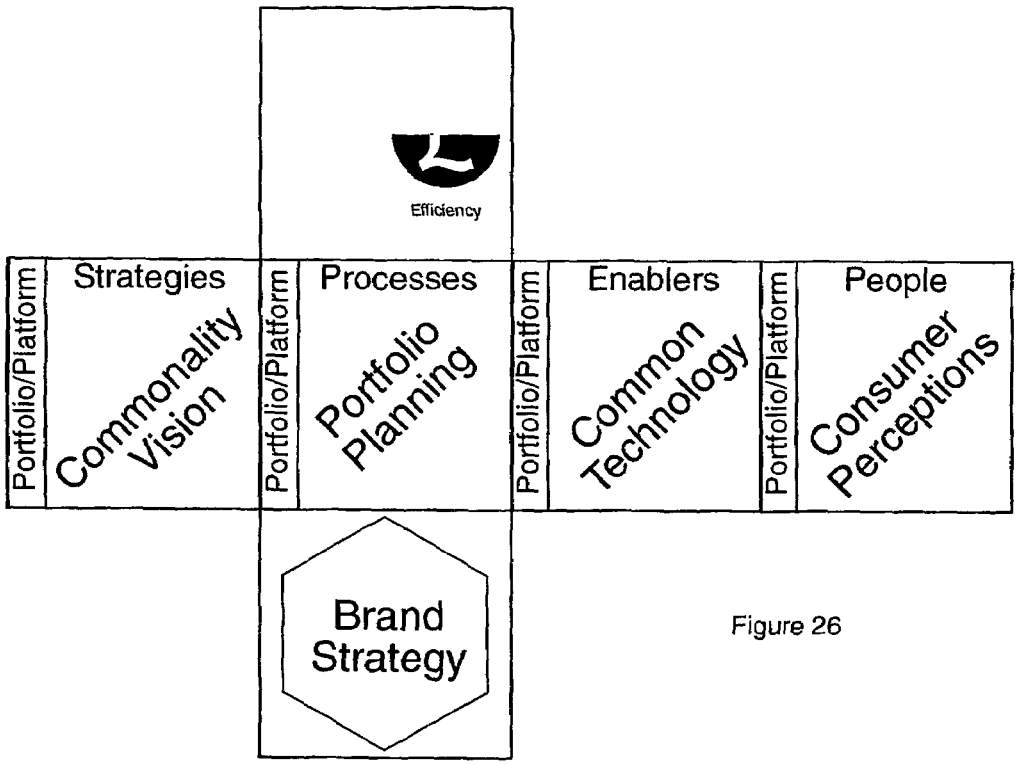

More specifically:

FIG. 17 addresses organisational or Business factors;

FIG. 18 addresses brand strategy factors;

FIG. 19 addresses portfolio strategy factors;

FIG. 20 addresses product strategy;

FIG. 21 is a facet summary (overview) chart of facet allocation, coding and marking, for the allotted topic cubes of FIGS. 17 through 20;

FIGS. 22 through 29 depict specific cube facet contents; both generalised and applied to a particular business context, in this case an airline—drawn to a common scale, although admitting of internesting, if relatively scaled;

Thus, more specifically:

FIG. 22 shows a facet arrangement for a generalised 'BUSINESS (LEVEL) ORGANISATIONAL' cube;

FIG. 23 shows a specific 'BUSINESS (LEVEL) ORGANISATIONAL' cube, derived from the generalised model of FIG. 22, applied to a (notional) airline business context;

FIG. 24 shows a facet arrangement for a generalised 'BRAND (LEVEL)' cube;

FIG. 25 shows a context specific 'BRAND (LEVEL)' cube, derived from the generalised model of FIG. 24, applied to a (notional) airline business;

FIG. 26 shows a generalised 'PORTFOLIO/PLATFORM (LEVEL)' cube; and

Figure 27:
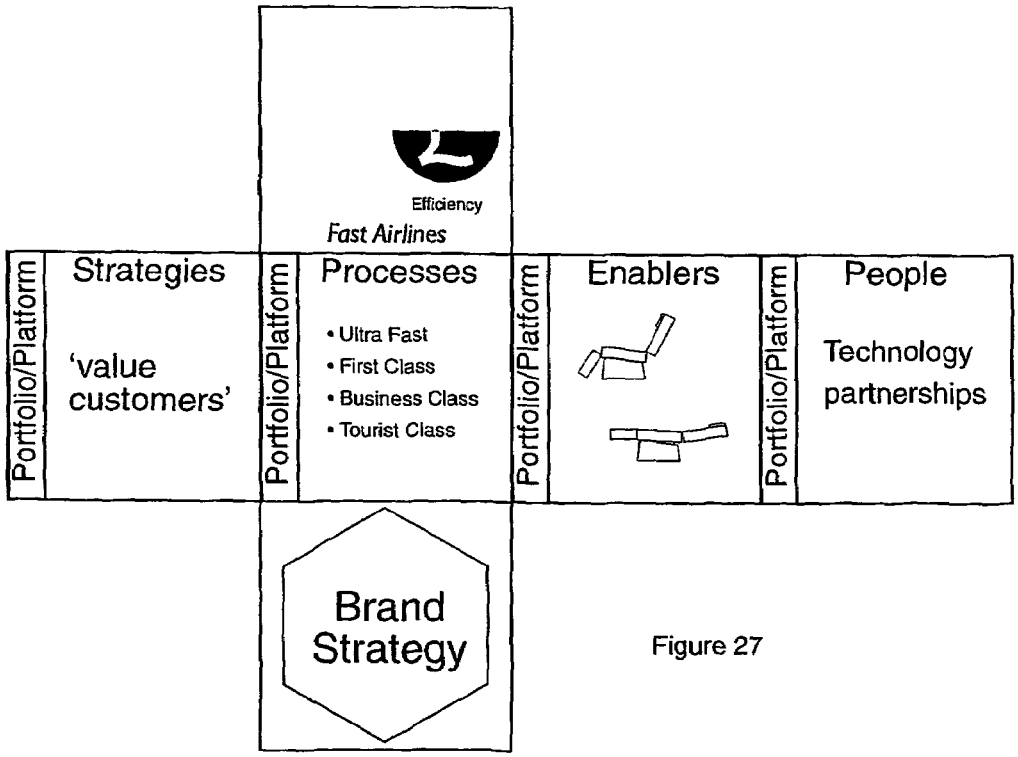
Figure 28:
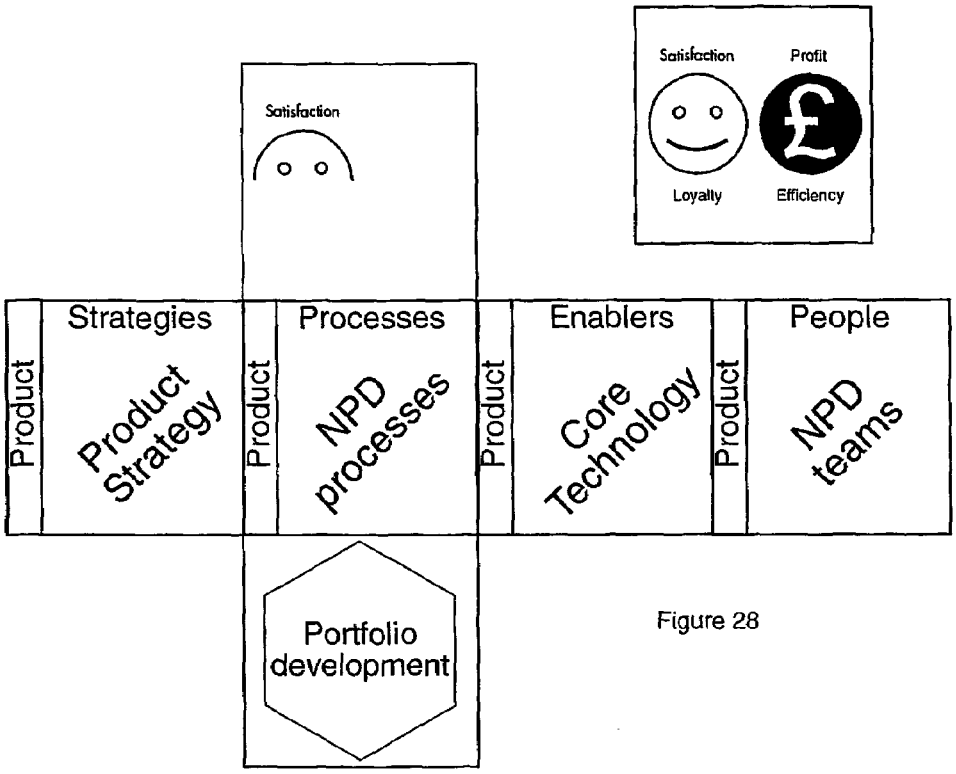
Figure 29:
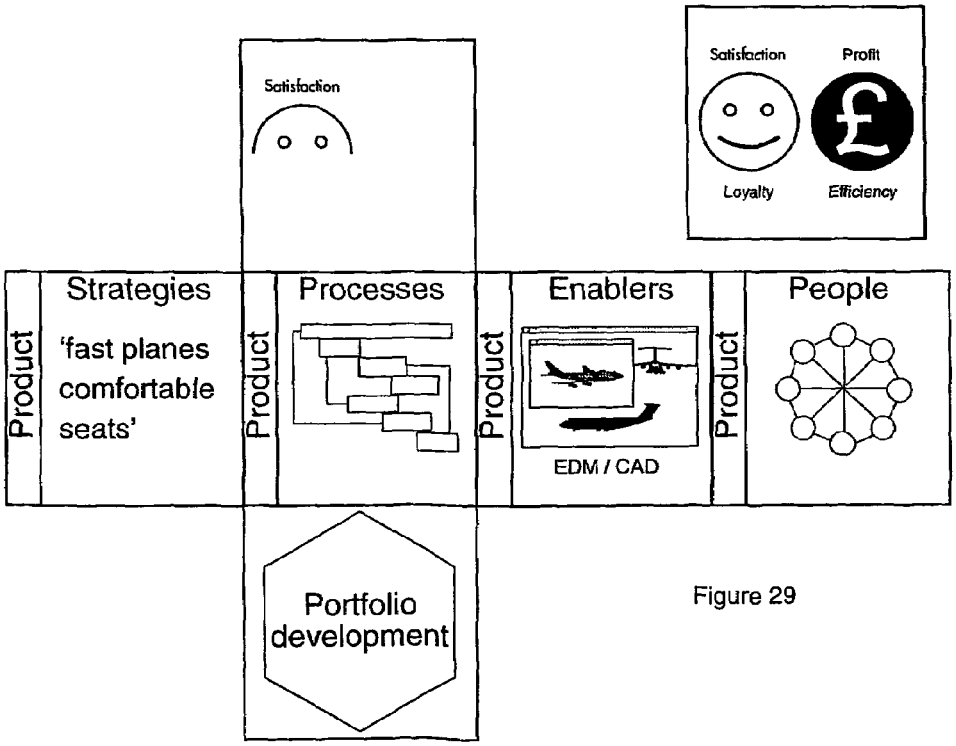
Figure 30:
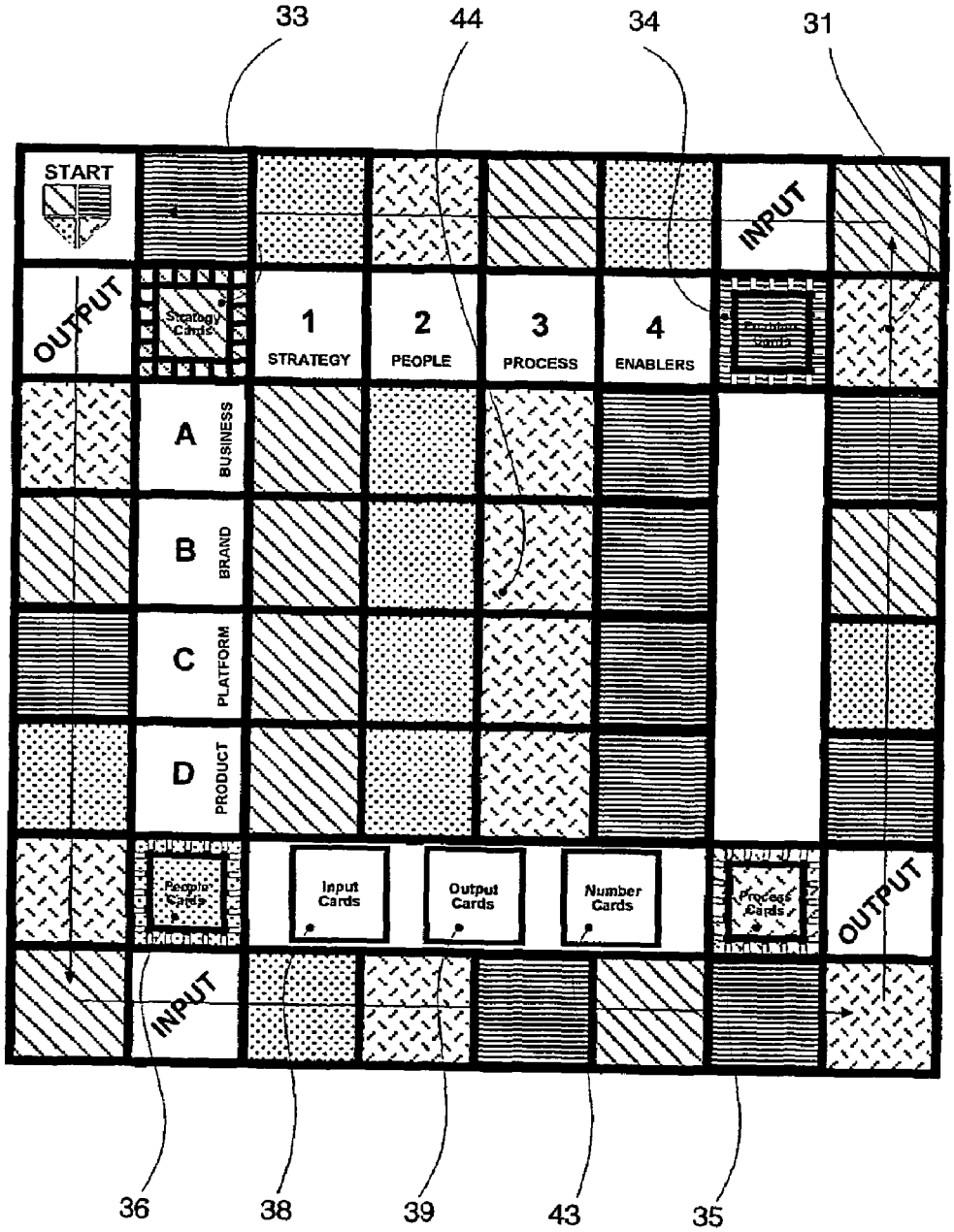
Figure 31A:
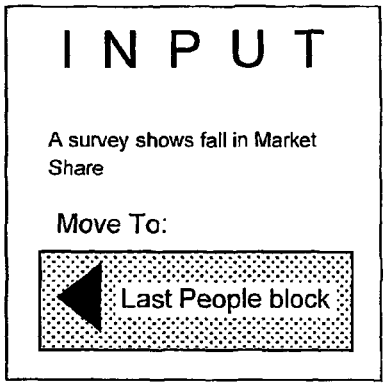
Figure 31B:
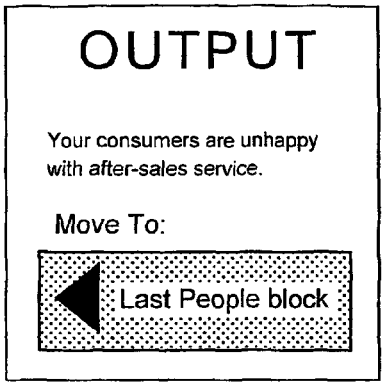
Figure 31C:
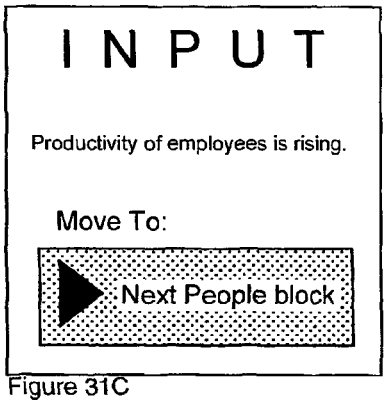
Figure 31D:
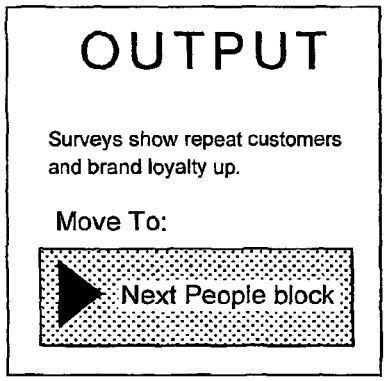
Figure 32A:
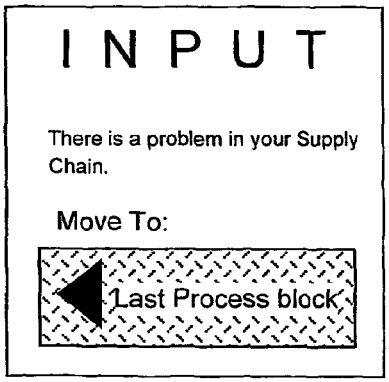
Figure 32B:
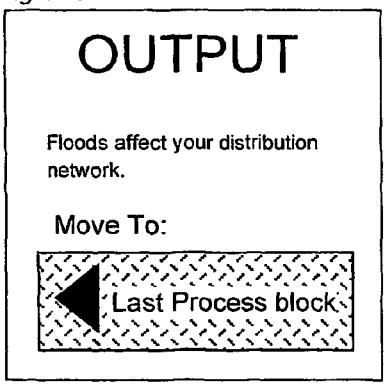
Figure 32C:
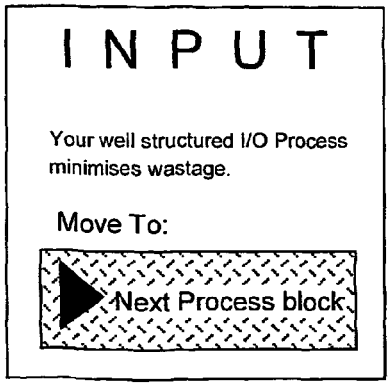
Figure 32D:
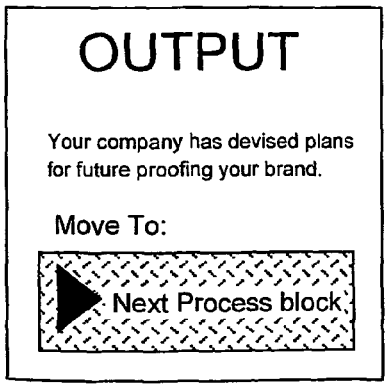
Figure 33A:
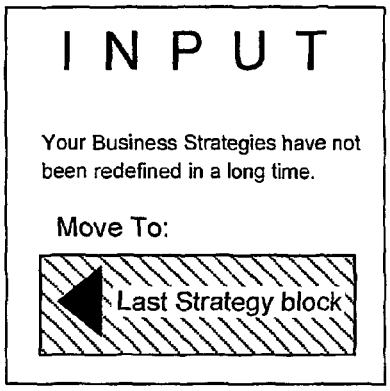
Figure 33B:
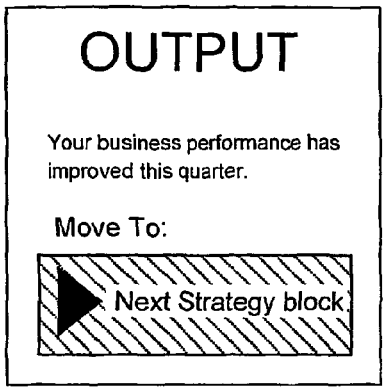
Figure 33C:
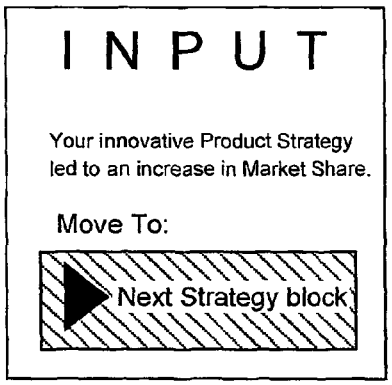
Figure 33D:
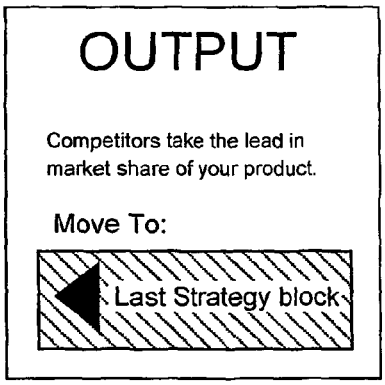
Figure 34A:
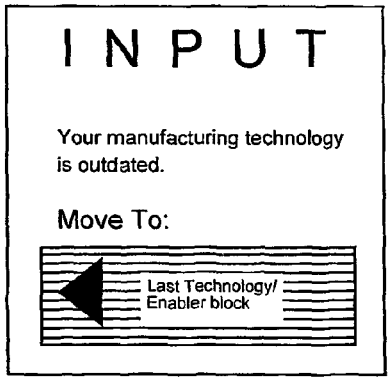
Figure 34B:
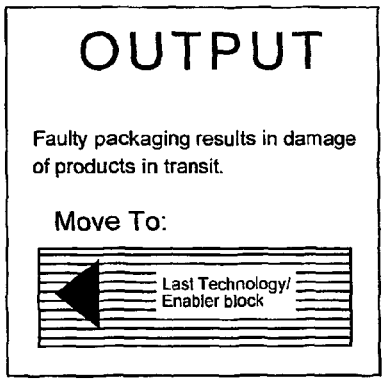
Figure 34C:
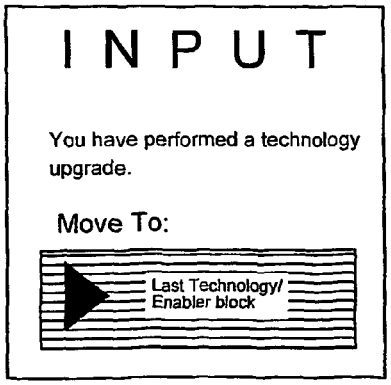
Figure 34D:
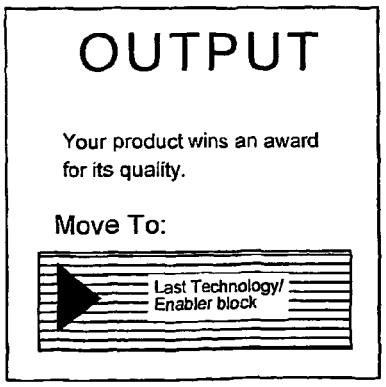
Figure 40A:
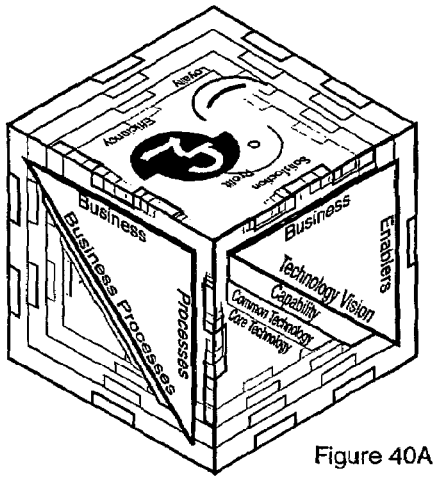
Figure 40B:
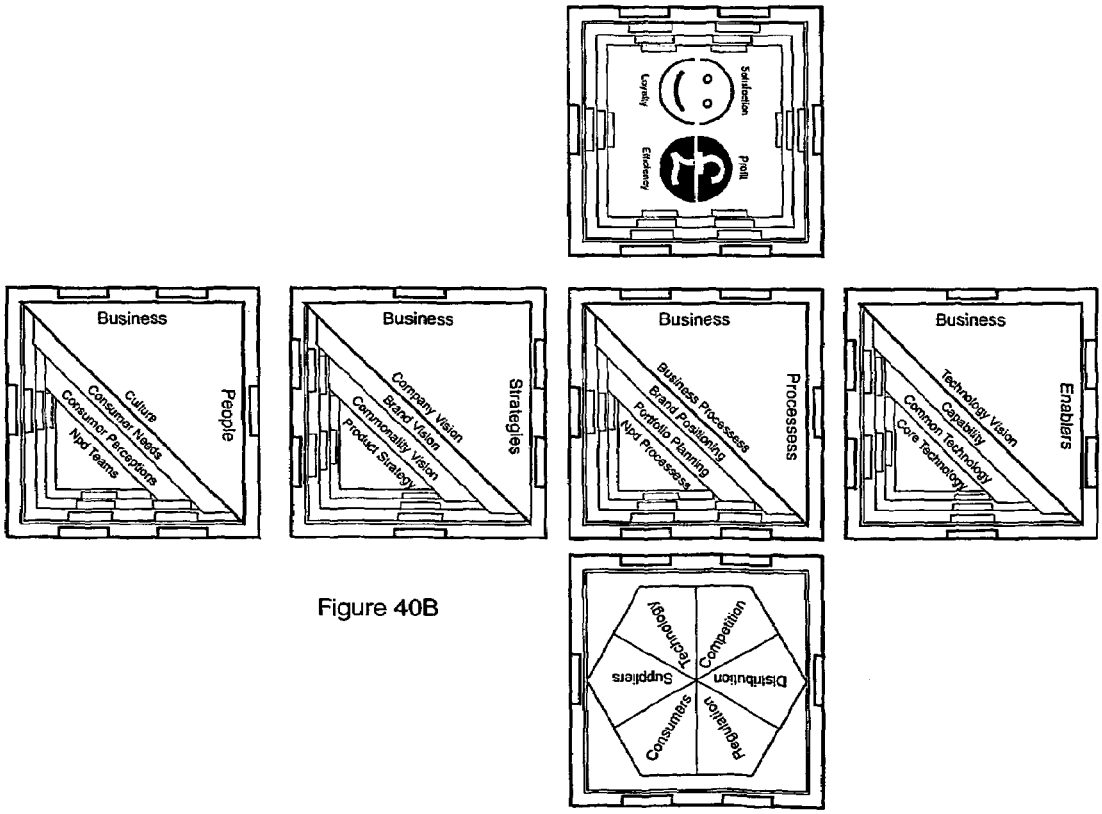

FIG. 27 shows a (notional) airline specific 'PORTFOLIO/PLATFORM (LEVEL)' cube, derived from the generalised model of FIG. 26;

FIG. 28 shows a generalised 'PRODUCT (STRATEGY & DEVELOPMENT)' business cube;

FIG. 29 shows a (notional) airline specific 'PRODUCT (STRATEGY & DEVELOPMENT)' cube, derived from the generalised model of FIG. 28;

FIGS. 30 through 39 relate to an associated or derivative board game adjunct to the topic cubes of FIGS. 1 through 29, in which game progress is contingent upon closer scrutiny and consideration of individual topics, addressed through playing cards marked with factors also identified in the construction of topic cubes and in particular the facet overlap and corresponding juxtaposition of markings attendant the internested [translucent] cube variants;

Thus, more specifically:

FIG. 30 shows a board playing surface area, subdivided into a rectangular (intersecting row and column) grid array of (colour and/or pattern) coded placement areas, for playing pieces (not shown); along with designated stacking points for supplementary feature cards addressing certain key topic categories; specifically, Strategy Cards, Enabler Cards, Process Cards, People Cards, Input Cards, Output Cards, and Number Cards;

FIGS. 31A through 31D show sample Input Cards and Output Cards with respective scenarios and attendant (playing piece) move instructions;

FIGS. 32A through 32D show further Input and Output Card variants to those of FIG. 31;

FIGS. 33A through 33D show more Input and Output Card variants to those of FIGS. 31A through 32D;

FIGS. 34A through 34D show still further Input and Output Card variants to those of FIGS. 31A through 33D;

FIGS. 35A through 35E show a series of category (colour and/or pattern) coded Query, or Chance Event cards, with various scenarios and options for election;

FIGS. 36A through 36E show a supplementary series of (different) category (colour and/or pattern) coded Query, or Chance Event cards, with various scenarios and options for election, to those of FIG. 35A through 35E;

FIGS. 37A through 37E show a further supplementary series of (different) category (colour and/or pattern) coded Query, or Chance Event cards, with various scenarios and options for election, to those of FIGS. 35A and 36E;

FIG. 38A through 38E show yet another supplementary series of (different) category (colour and/or pattern) coded Query, or Chance Event cards, with various scenarios and options for election, to those of FIGS. 35A through 37E;

FIGS. 39A through 39F show a series of (move) number cards, for determining multiple placement area traverse;

FIGS. 40A though 40D show a set of inter-nesting, different sized, translucent cubes—allowing viewing of data portions upon individual cube facets;

More specifically:

FIG. 40A shows a 3-D view of four inter-nested cubes with respective triangular 'labels' correctly aligned to convey a desired cumulative or composite message; and FIG. 40B shows 2-D side elevations of all six sides of the interested cubes, with composite facet marking.

Figure 40C:
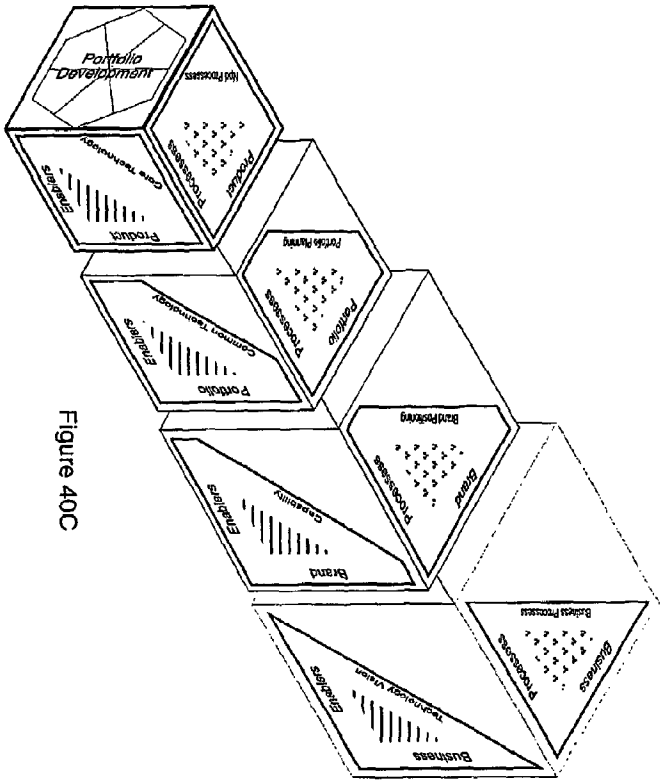

FIG. 40C shows 3-D view of the four cubes of FIGS. 40A and 40B relatively displaced, so that the data on two sides of each cube is visible, namely respective process and enabler facets.

Figure 40D:
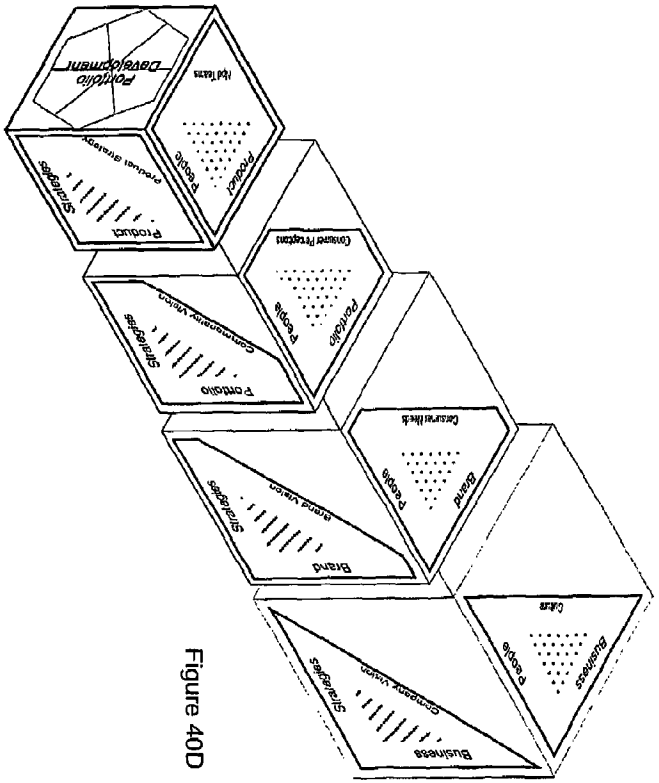

FIG. 40D shows two other (diagonally opposed) sides of the cubes depicted in FIG. 40C, namely respective people and strategy facets.

Figure 41:
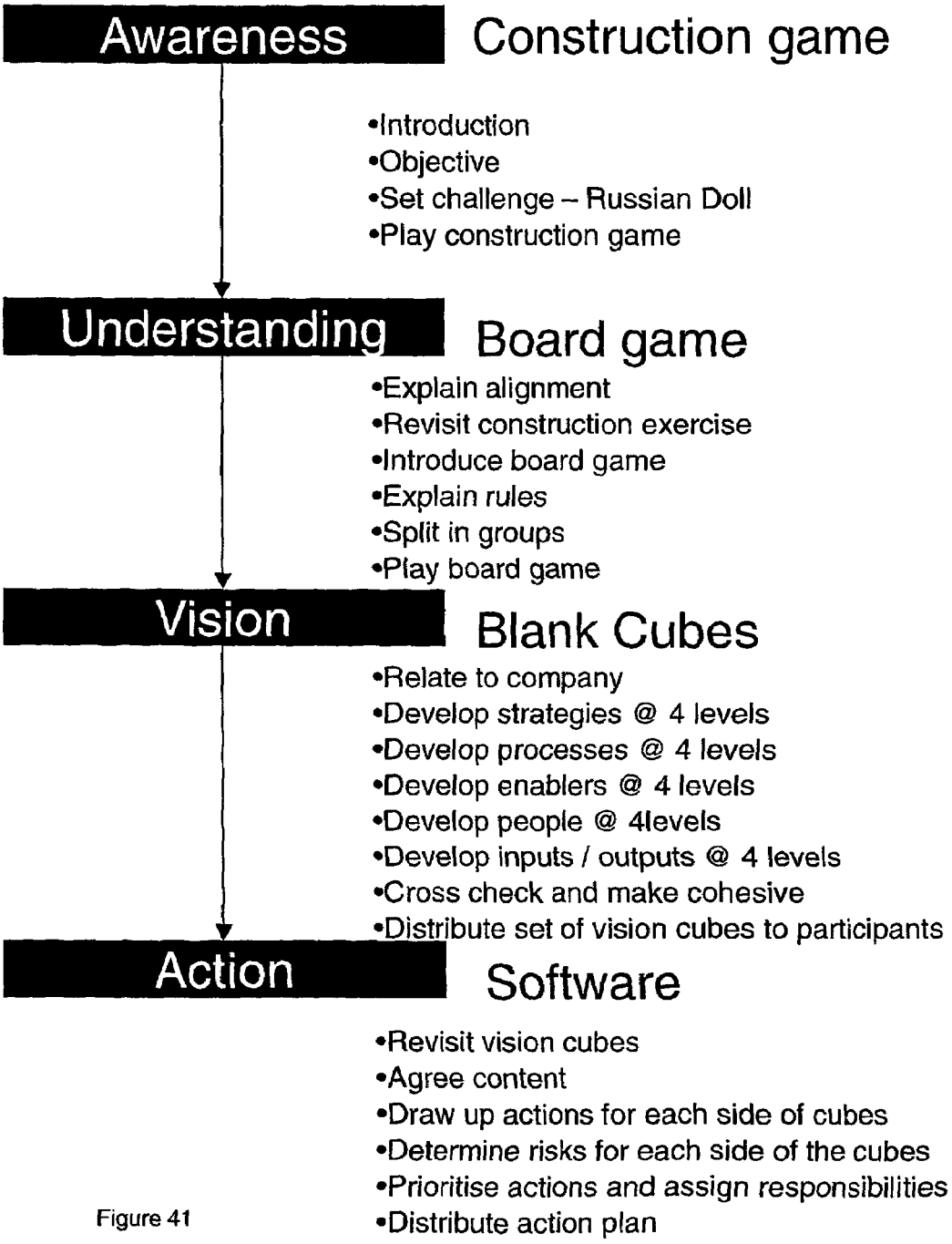

FIG. 41 shows a flow chart depicting distinct phases of game activity, each with respective supporting tools.

FIG. 42 shows a sample blank chart for use in determining the 'considerations' in developing a 'common vision' for an organisation, using topic identities/headings of the cube and board game.

FIG. 43 shows a sample blank chart for use in determining the 'considerations' in developing a list of actions for an organisation, to meet its common vision, grouped according to the cube and board game headings.

FIG. 44 shows a sample blank risk matrix.

FIG. 45 shows example cube facet levels and factors, with sample relevant statements, these can be customised to each complex situation.

DETAILED DESCRIPTION OF THE INVENTION

Referring to the drawings and in particular FIGS. 1A through 2C, a particular individual game activity playing piece 11 is configured as a 3-D structure. In this example, the 3-D structure is rectangular—specifically a cube—although other forms, such as pyramids, as shown in FIGS. 6 through 9, could be employed.

Generally, flat-faceted polygonal structures are more readily fabricated from flat sheet material, whether as discrete panels, assembled as in FIGS. 13A through 14C, or from a cut and folded carton blank, as in FIGS. 2A through 2C. That said, in principle, curved forms, such as spheres and ovoids, could be employed.

The 3-D structure may be solid, or hollow. A hollow form has advantages in enabling the symbolism of an internested form—and with facet markings a hierarchical inter-relationship. Thus a hollow cube can hold certain contents—such as interfitting other such cubes, appropriately scaled (relatively), for co-operative mutual internesting.

As shown in FIG. 1A, the cube facets 15 could be (initially) left (partly or entirely) blank, for freedom of subsequent self-marking. Generally, self-marking represents a more advanced game activity stage or version.

Alternatively, cube facets could be pre-marked—for particular game activity factors. Generally, pre-marking represents a more basic (learning or familiarisation) version of the game activity.

FIGS. 1A through 1C embody exemplary facet markings 14 as a linear grid array of transverse ruling lines—with optional background in-fill—creating a series of stacked rows, on each facet 15. FIGS. 17 through 20 and 22 through 29 reflect variant facet layouts.

Alignment

Multiple individual playing piece cubes 11 may be arranged (e.g. alongside, stacked—or most effectively interested) together, to present respective facets in juxtaposition. Such alignment of facet markings is significant in allowing the game to convey corresponding alignment of meaning or significance accorded to those markings.

Thus a plurality of such playing pieces 11 is desirably relatively configured, i.e. shaped and sized, for (snug) co-operative inter-fit, or inter-nesting—as shown in FIG. 10.

Participant Build—Playing Piece Cube

In certain versions, or at certain stages of game activity, an individual playing piece cube 11 may be assembled into a 3-D erect form, say from a 2-D flat 'carton blank' sheet—as shown in FIGS. 2A through 2C. Building a playing piece cube 11 then becomes a challenge in itself, prefacing or independently of use in conjunction with a playing area.

Participant Build—Playing Area

Indeed, the playing area itself admits of bespoke design and construction by game participants. The playing piece cubes 11 have a role on their respective individual accounts—and collectively.

A relationship between, and attendant interaction with, playing piece facets 15 and placement areas 19 of a dedicated playing surface 18 allows consideration of additional game activity factors—with deeper meaning, and complexity of analysis. That is another level of marking, and associated meaning, alignment is possible. This is particularly so in relation to respective markings, expressed as words, on the facets and placement areas.

Playing Area—Marking

A playing area may be used with standard board game playing pieces which simply differentiate players—without special association between playing piece facets and board placement areas.

A dedicated playing surface 18, such as shown in FIG. 1B, is an optional adjunct in relation to cubes 11, insofar as they have a self-contained significance. A specially laid out and marked playing surface, such as shown in FIG. 30, for generic playing pieces (not shown), has a role at another (subsequent) stage in the overall game activity.

Thus, the board game is generally played after a preliminary round of cube construction and assessment. Essentially, the board game allows deeper consideration of cube facet markings, whereas the prefacing construction phase gives a broad overview.

Game Activity Scheme(a)

FIGS. 17 through 20 depict particular cube topic allocation and cube facet marking schemes. Generally, each facet is accorded a particular topic or category, with sub-division into related component strands.

The facets shown are merely indicative, and the detailed content and layout admits of considerable variation—not least with a transition from pre-marked cubes, to blank faces for participant marking and selective infill.

FIG. 16 summarises, in outline schematic chart form, an example hierarchy of various individual topics (relating to Innovation), and themselves addressed and sub-divided into categories on discrete playing piece cubes. This categorisation and attendent inter-relationships are explored in the follow-on board game phase.

A full game sequence is relayed later under the sub-heading 'Facilitator's Guide', but a general overview follows. A preliminary briefing, possibly supplemented by an introductory pass, or round, of game activity, relays the overall category and (sub) topic schema to participant players.

A 'theoretical' underpinning understanding of operating principles, constraints (rules) can be conveyed explicitly at the outset, delayed until a later stage, or allowed to emerge from experience with the game activity—or some combination of these.

Introductory Assembly Kit

At the start of a game activity, players can be presented with a loose 'jumble' of playing pieces—rather like the initial challenge of a jigsaw.

Emergent Meaning & Awareness

That is the shaping of individual pieces and their markings give clues to an inter-relationship, association or grouping—which is initially obscured by the random assortment, but which is progressively revealed upon a cogent sorting and coherent assembly into 3-D forms. Emergent meaning, and spontaneous awareness in the minds of participants—i.e. unprompted by a moderator or facilitator—is an important consideration and benefit of the game activity.

From the jumble of pieces, participant players are then tasked to review the playing piece individual content and strike some rationale, by determining the individual playing piece contribution towards a larger, more collectively, meaningful [whole] picture, perspective or overview.

In this process both sides of a 2-D playing piece could have 'competitive' alternative significance, towards a decision upon juxtaposition of playing pieces, and construction of a 3-D structure.

The assembly kit challenge or exercise, using a set of pieces, such as shown in 13A through 14C, and the extrapolation to internesting of FIGS. 15A and 15B, introduces participants to spontaneous analytical thinking and co-operative tasking.

Interfitting Edge Profile

The edges of the pieces have a stepped profile for co-operative interfit, to help preserve the integrity of the assembled structures, and allow handling while the juxtaposed markings are displayed for contemplation as to a deeper underlying significance.

At the outset, the cube facet markings and [topic or category] coding present powerful and prominent visual clues to participants presented with an otherwise unfathomable, disparate, loose collection of pieces.

Colour is a convenient first level of coding and interpretation, allowing grouping by common colour, followed by further sorting by size and shape. This allows participants to start intuitively the task of preliminary sorting and grouping by colour, then by size, to construct a set of four progressively scaled cubes.

Internesting Hierarchy

By sequencing the assembly, that is leaving one face open until the cube is filled with one or more others, the cubes can be internested, as shown in FIG. 15B. The symbolism of internesting suggests a hierarchy or tiered relationship—to promote game progress and is fundamental to a deeper topic understanding.

Generally, in the context of the game activity, a multiplicity of 'abstract' contributory elements or factors are identified—through the marking or labelling of playing piece (e.g. cube) facets—and sorted or resolved into a rationalised or ordered context or structure—through assembly and interaction of physical playing pieces. This is more readily comprehended from the specific examples of FIGS. 16 through 29.

The act of handling the playing pieces and reviewing their identities helps a process of sorting, grouping, allocation and constructive assembly. Thus, in a sense, there is an ongoing 'reveal', or regulated exposure of the game activity content and underlying purpose—admitting deeper levels of comprehension and understanding to evolve 'naturally', as the game activity progresses.

Tools & Toolset

Such 'self realisation' is a potentially powerful learning and reinforcement tool. In that regard, cubes can themselves be regarded individually as ('learning-by-doing') 'tools' and collectively as a 'toolset'. Interdependence of factors is conveyed by both the assembly of facets into playing pieces, and the internesting of playing pieces.

Russian Doll

As a visual clue, the participants can be shown a Russian Doll toy set of internesting FIG.s. of complementary form. Such symbolism can convey, without the need for laborious 'prescription', a fundamental rationale or purpose of completeness, or integrity, co-operative order, and hierarchical ranking.

Thus, in order to convey a hierarchical inter-relationship of cube topics, the cubes—whilst similarly shaped—are differentially sized to allow mutual internesting—examples of which are depicted in FIGS. 11E, 12E, 15B and 16. In practice, for such internesting, one cube face may be absent altogether, or removable, to gain access to the hollow interior—and any contents.

In this instance, the largest cube 22 is allotted to the broadest or overall topic, namely ORGANISATION or BUSINESS, or, more specifically, organisational factors or criteria. The next largest cube 23 is allotted to the next broadest, or most important topic, namely BRAND—or more specifically brand strategy and development factors or criteria. The third cube 24, ranked in size order or succession, is allotted to PORTFOLIO—or more specifically portfolio strategy and development factors or criteria. The smallest, innermost, and fourth cube 25, is allotted to PRODUCT—or more specifically product strategy and development factors or criteria.

These gross categories—ORGANISATION or BUSINESS, BRAND, PORTFOLIO and PRODUCT—admit of some judicious variation better to suit game participants, or rather the nature of their (common) organisation. The nest of cubes represents the progression of thinking, and visually and structurally serves a valuable aid memoire—for the next round in the game activity.

Cube Facets

Collectively, the cube facets represent the aspects of the individual topics, namely: ORGANISATION or BUSINESS, BRAND, PORTFOLIO, PRODUCT—and so direct and guide further analysis.

Thus, for the ORGANISATION (AL) cube 22, FIG. 17 depicts marking upon four cube (side) facets—namely: STRATEGI.E.S, PROCESSES, TECHNOLOGY, PEOPLE.

Similarly, for the BRAND cube 23, FIG. 18 depicts marking upon four cube (side) facets—namely (again): STRATEGI.E.S, PROCESSES, TECHNOLOGY, PEOPLE.

In this instance, the same initial layers of sub-division are employed as for the ORGANISATION(AL) cube 22—but different terms and concomitant analysis may be used in game activity variants. Similarly, with the PORTFOLIO and PRODUCT cubes 24, 25, FIGS. 19 and 20 respectively.

(Side) Facet Sub-Categories

The sub-categories on each (side) facet vary between facets and cubes. Thus, for example, with the ORGANISATION(AL) or BUSINESS cube 22, STRATEGI.E.S is sub-categorised under: ORGANISATIONAL CHANGE, BUSINESS STRATEGY, COMPANY VISION, BUSINESS DRIVERS.

In contrast, on the same ORGANISATION(AL) cube 22, PROCESSES are sub-categorised as, or by: OUTPUTS, INPUTS, BUSINESS PROCESSES.

Again, on the ORGANISATION(AL) cube 22, TECHNOLOGY is sub-categorised as, or by: TECHNOLOGY VISION, DEPLOYMENT, RESOURCES.

Lastly, on the ORGANISATION(AL) cube 22, PEOPLE are sub-categorised by: CAPABILITY, CULTURE.

The cube (top and bottom) end faces 28, 29 may be marked with related issues, and/or summaries of the side facet contents. Thus, for example, the bottom end face 29 of the ORGANISATION (AL) cube 22 is sub-divided into four triangular segments, designated respectively: EXTERNALS, COMPETITION, CONSUMER, TREND.

These are essential INPUTS, or input (ingredient) influence factors. Such INPUTS also feature in the board game of FIGS. 30 through 39.

The top face of the same ORGANISATION(AL) cube 28 is simply marked with the summary objective: IMPROVED BUSINESS PERFORMANCE This is essentially an OUTPUT or desired outcome or target. Such OUTPUTS also feature in the board game of FIGS. 30 through 39.

Similarly, complementary colour coding of cubes and facets helps communication, recognition and recall of associated issues. FIG. 21 is a facet summary chart of the innovation cube schema of FIG. 16 and the individual cube layouts of FIGS. 17 through 20, expressed with additional columns for INPUTS and OUTPUTS. Each row spans an individual cube side and end faces for a given topic heading. Successive rows are ordered to represent levels in a hierarchical relationship—itself evoked by the relative scaling and internesting of cubes.

Initial Game Activity Round

Familiarisation with the game activity structure and purpose is more readily gained with a set of pre-marked cubes. Thus, for example, a moderator or facilitator (whose briefing guidance follows later) can introduce game activity participants to an overall topic toy using a pre-marked set of internested cubes as an aide memoire, to both the moderator and the participants.

The pre-marked examples of FIGS. 16 through 29 could be used to this end. Each topic facet can be considered in turn, with visual identification and supporting discussion of the constituent elements or factors. Attention can then be turned to another facet, with similar analysis of related factors.

Facet (contributory) factors can be layered, in transverse (e.g. horizontal) strata, to represent a hierarchy of significance or importance—with, say, an uppermost layer accorded most significance. Similarly, (inter-)relationship with corresponding (contributory) factors in other topic categories, depicted upon adjacent facets, can be identified, by turning the cube.

A common target outcome or objective to each facet can be relayed upon the upper face of the cube. A similar 'exposition' strategy can be employed with other cubes, as they are revealed in turn from—and/or returned to—an internested stack.

Having been taken through a broad and generalised analysis, the participants can be taken through a parallel exercise with topics and contributory factors more specific to their commercial situation.

Alternatively, in a more consolidated or focussed game activity version, participants can be addressed firstly with an 'industry-specific' game activity version. Thus the example cubes of FIGS. 16 through 29 include both generalised and business specific examples.

Game activities and playing pieces can be tailored to participant groups, according to their business role. Thus, say, a version for a board of directors, could differ from that tailored to shop floor or production line workers.

That said, the game activity is a valuable tool for communication across departmental, sectional or functional disciplines—since its underlying purpose is to convey interdependence of diverse contributory factors. That is a larger or wider overall objective cannot be reached through a narrow spectrum of factors.

Game Activity Outcome

The game activity may identify a need for organisational change—but predisposition towards, or authority for, implementing such change is not assumed.

Nor are the results or consequences of applying the game activity to specific situations directly or immediately evaluated or audited. Rather, the game activity is concerned with awareness-raising, and self-implementation or fulfilment.

The game activity is not, and need not be, directly or overtly prescriptive—but rather engender a shared comprehension of contributory factors and their interaction. In that sense, there is no immediate feedback or test of outcome or performance. Rather evaluation is also emergent as participants share involvement in adjusting the contribution or weighting of ingredient elements or factors.

It is envisaged that variants of the game activity be played by representatives from across and organisation. Initial game activity playing can be in groupings from related departments and/or at similar levels. Follow-on game activity playing can be across departments and at mixed levels, an evolutionary learning process can be achieved.

'Applied' Game Activity Round

Having gained some awareness of, insight into, and appreciation of, factors or criteria to be considered, a particular situation—real or imaginary—is addressed. In this 'applied' game activity round, certain cube faces can be left largely blank. That is to say, broad topic headings can be left, for guidance, but the sub-categories are left to the player(s) or participants themselves to express—not in general—but in specific terms to a role or situation.

This applied round may address a current workplace scenario, problem or project. The cubes help discipline and focus debate—of both individuals and collectively over a team—upon issues for consideration, debate and conclusion. Thus an applied situation could seek a generalised, or diffuse, outcome—such as IMPROVED BUSINESS PERFORMANCE—output consideration, or a more specific target could be identified, qualitatively and/or quantitatively. Participants could be left to decide their own game activity purpose, target or outcome.

Game Activity for FIGS. 22 through 29

Four broad cube categories of ORGANISATION or BUSINESS LEVEL, BRAND, PORTFOLIO and PRODUCT are used. The cubes are relatively sized in levels' in a orderly structured hierarchy. A contributory target 'portion' is identified at the top face of each cube.

Thus PROFIT is a target associated with ORGANISATION or BUSINESS LEVEL. Similarly, LOYALTY a target associated with BRAND, EFFICI.E.NCY is a target associated with PORTFOLIO, and SATISFACTION is a target associated with PRODUCT.

Each cube has a corresponding set of side facets, STRATEGI.E.S, PROCESSES, ENABLERS and PEOPLE. A lower cube facet is allocated to linking and interaction and/or topic 'drivers'.

Game Activity Schema

In a particular construction phase, an inter departmental team—desirably of some four to six players, for manageability and participation—is allocated a complete set of twenty four playing piece facets, collectively making up four cubes, following the broad categories of FIGS. 22 through 29.

Individual player allocation is randomised by pre-sorting, demanding co-operation between players in contributing associated facets necessary to complete each cube.

A clue or direction as to the construction or assembly target or objective structure(s) would be given—say by the Russian Doll toy (i.e. multiple internesting wooden doll FIG.s.) symbolism and/or verbally, by reference to a set of geometrical shapes.

Once the team has a shared vision of the outcome, it can be left to self-direct, to a common or shared purpose, by perceived 'ownership' of the activity.

Transparent (top) facets on each cube hold a visual clue to intended cube orientation and internesting sequence—by relaying a completed message once the correct 'solution' is achieved.

A game activity moderator, facilitator or supervisor can draw out points upon the progress, obstacles and achievements through such necessary contributory factors as shared information, complementary expertise, and collective task understanding.

Once assembled and internested, the teams will be led by the facilitator into an analysis—by cube separation and examination—of the deeper underlying game activity significance and symbolism (e.g. levels, issues and processes) to real world business situations.

The initial construction phase of game activity is essentially an 'awareness raising' exercise, with a generalised set of cubes, such as of FIGS. 22, 24, 26 and 28. This can preface game activity sessions with more industry specific cubes—such as of FIGS. 23, 25, 27 and 29—and a follow-on board game activity phase.

Board Game Activity

Subsequently, more challenging game activity sessions—towards developing topic understanding—can require a board game activity, with a playing area (e.g. flat board), playing cards and random chance selector (e.g. throwing dice).

The playing area is sub-divided into successive playing piece placement areas, along a prescribed playing path 31, representing progress, towards a symbolic objective. Individual placement areas may be colour and/or pattern coded—in conformity with individual cube facet colouring and/or patterning.

Thus, four cube facets could be allocated four different colours, shades, hues or tints. Notional symbolised 'obstacles' and 'accelerators' (not shown) are distributed along the path. Four sets of playing cards strategy 33, enabler 34, process 35 and people 36, together with input 38 and output 39 cards, and number cards 43—which may be colour/pattern co-ordinated with a cube facet colour/pattern—are set (face down in a stack) upon or adjacent the playing area and bear game activity directions.

Dice are shaken and thrown by each player in turn, to determine an incremental progress step for the respective playing piece.

According to the playing area colour landed upon by a playing piece, so a card is selected from the top of the stack of correspondingly coloured cards and the (activity) statements of directions expressed, or allocated, are 'implemented' by the player.

The player drawing the card is tasked or challenged—if necessary in consultation with other team players—to allocate it the card 33, 34, 35 or 36 on the positioning grid 44.

Similarly, a playing piece landing upon an obstacle square, input or output, can be used to introduce yet another element of progression or regression, reward or penalty.

A game activity round continues until the first playing piece reaches the end of the path depicted on the playing area. At this juncture, the team examines and reviews the allocation of topic cards to cubes or cube facets. The intention is to analyse the associations previously made and appraise their validity or appositeness.

Team consultation allows discussion and negotiation towards manipulation or sorting of topic card statements or directions into a collectively agreed (meaningful) association, sequence, or allocation, in relation to the overall game activity business topic—such as implementation of (design) innovation, crisis management, or complex issue rationalisation.

As with the prefacing cube construction phase, the board game rules and constituents admit of considerable adaptation to (business) circumstances, whilst preserving the link with the earlier phase.

Software

It is envisaged that bespoke software could be used for this ultimate design challenge and purpose. Such software would be a vehicle for customising generic statements into more business specific terms.

Software could help identify and resolve conflicts between topics and topic sub-divisions or hierarchical levels. Moreover, software could contrive implementation tools to help realise an agreed business or project structure.

The outcome could be printed out as a hard copy aide memoire—say on the pre-perforated masks previously identified in relation to FIGS. 4A & 4B. The players could then construct a 3-D model evocative of the 'solution'—as an ongoing prompt.

Facilitators' Guide

A facilitator or moderator has a key role in game activity and rationale—in relaying its application to a participant organisation through representative delegates. The broad objective is to develop a shared vision for the organisation and a realisation action pathway, if not plan.

The game activity is applied in (four) distinct phases, each with respective supporting tools, as shown in the chart of FIG. 41. The purpose of each phase is: common awareness; understanding; vision and action.

Game Activities

It needs to be emphasised that the objective is not 'winning' game activities. Rather, game activities are process steps to a common vision and action plan. Thus participant teams are not opponents—just as they should not be in their organisation. In that sense, the term 'game', or even 'game activity', might be misleading and simply 'activity' more appropriate.

Preparation

Before setting the date of a first workshop, the facilitator needs to comprehend the organisation, its activities and interactions between people and functions, whereupon there is a need to:

Determine participants—with project sponsor;

Group people according to function into 3 or 4 multi-disciplinary sub teams;

Phase 1: Awareness

Construction game activity—to raise awareness of need to align participants.

Introduction: Introduce facilitator and participants.

Objective: Explain objective of event.

Topic (e.g. Innovation): What is innovation?

Examples of good and bad innovation.

Difficulties in innovating.

Factors and issues that play a part.

Innovation in client organisation's context.

Innovation methods and processes.

Challenge: Show Russian Doll toy.

Hand out 24 construction pieces.

Start time—mention 'record' time.

Stand back and observe interactions—don't interfere.

Alignment Explain concept of alignment using set of cubes constructed:

if perfectly aligned, move to Board game activity;

if misaligned, give participants opportunity to reconstruct aligned set.

NB: There are no specific rules to this activity, as it is up to participants to discover how to construct cubes. Lack of rules and non-interference makes it a valuable exercise and will result in the framework being accepted faster.

Phase 2: Understanding

Board game activity—to relate the concept of alignment to the organisation.

Relevance

What does it mean to you in participants' organisation?

How do participants use this?

1. Place cards 33, 34, 35 and 36 on marked areas, printed side up (place stack of 'people' cards upon square marked 'people cards')
2. Divide participants into 3–4 groups, each with representatives from different functions.
3. Each team has a different coloured playing piece.
4. Place playing pieces on square marked 'start'.
5. Throw die. to determine which team starts.
6. First team throws die. and advances designated playing piece accordingly.
7. Pick up card correspond to colour of square that team landed upon.
   a. If landed on 'Input' or 'Output' square, the corresponding card 38 or 39 contains an instruction to move forward or backward to a coloured square.
   b. If landed on shaded or coloured e.g. blue/green/red or yellow square, corresponding card 33, 34, 35 or 36 contains a scenario or question related to strategy/enablers/process or people or respectively.
8. The other teams throw dice, until all have one (shade or colour coded) scenario query card. Teams are given a certain amount of time to discuss given responses, to decide which they would choose, in order of preference. A blank space on each card gives teams option to add another solution.
9. All teams gather around game activity board and a representative of first team reads out the question and scenarios given. The team presents its preferred scenario and alternatives and indicates the order of preference, explaining why they arrived at their conclusion.

10. The game activity card is placed on corresponding square on 'Positioning Grid' 44. Thus, if, say, a team decides that an issue needs to be addressed through a new technology platform, it would put that card on C4; alternatively repositioning the brand would place card on B3.
11. Alternative solutions are explained, and marked in order of preference, using number cards 43.
12. Card with question remains upon 'Positioning Grid' 44; number cards are put back on their square.
13. Next team follows with explanation and leaves card on grid, until all teams have had a turn.
14. First team throws die. again, moves to relevant square, picks up a card, etc
15. After a while there should be enough game activity cards upon 'Positioning Grid' 44 for a pattern to emerge. Many cards could be placed in diagonally hatched/one colour boxes, indicating that participants' organisation's first response to issues is in revising its strategies. A large number of cards on stippled/alternative colour 'people' boxes might indicate that they are focussed on using their people to respond.
16. If all question cards are exhausted, playing piece is moved to next block and team picks up relevant card.
17. The activity ends when:
    a. There are no more question cards
    b. Teams decide to stop
18. Discussion of outcome or end result, process, feelings and findings.

This should be a good point for a [lunch] break.

Phase 3: Vision

Vision—to generate, develop and communicate a shared vision

After previous exercise, participants should discern how their organisation responds to issues and appreciate each other's approaches and motives. It is now time to develop a common vision for organisation using the cubes. The facilitator uses a grid on a whiteboard flipchart. FIG. 42 represents a chart of such considerations. Vision activity is based upon brainstorming the chart contents and inter-relating contents.

The number of participants determines if they stay in their teams (more than say ten) or do this activity all together. Also the facilitator needs to decide to use:

'horizontal' approach (starting with inputs, strategies, processes etc on product level and working up or at business level and working down), or 'vertical' approach (starting with inputs at the 4 levels and working through strategies, processes etc).

The sorts of questions asked are:

What inputs and factors affect business?

What is the vision for brand?

What does this vision mean for processes at brand level?

How does the brand vision relate to platforms?

What does this mean for people at that level?

etc

Teams need to formulate short responses, put in their relative position on the grid. Once the grid is filled, statements need to be cross-checked—and might have to be revised. This should be the end of the day, as delegates will be tired at this point.

The facilitator needs to explain that at the next meeting—say, about a week later—chart will be reviewed, once everyone has had opportunity to think and discuss further. The amended chart forms the basis of next phase—action plan.

Phase 4: Action

Plan—to develop a plan of actions, to achieve alignment and innovation.

Implement—to manage and realise innovation.

Facilitation and consultancy—to develop and implement a shared vision.

Software—to communicate, manage risk and plan.

Participants meet again and modify and agree content of revised vision, using grid from the previous activity. Activity is again based on brainstorming each box on the grid systematically and asking questions such as:

If this . . . is our agreed brand strategy what does this mean?

What have we got to do to get there?

If this is the enabler that we need to realise our products what does this mean? Which are more important?

How do we resource it?

Result will be a list of actions grouped using cubes headings.

This list will be put in matrix format, with columns indicating priority, weighting, dates and responsibilities. FIG. 43 shows a chart of such considerations. Once complete, this list can be sorted in order of importance or dates. A similar format can also be used to brainstorm risks using questions such as:

What happens if we do not get this enabler?

What is the risk of not meeting this target? What happens if we don't?

What is the risk of our competitors copying our technology? What do we do to avoid this?

This exercise will add to actions list and also produce a risk matrix; and example being shown in FIG. 44.

Although the game activity has been described in terms of business and commerce, it is more widely applicable to issues of complexity and alignment. Alignment embraces sharing, commonality and harmonisation of perceptions and concepts of issues among participants. Thus, as and when participants share a common standpoint and viewpoint, they are more likely to think and act constructively in concert.

As a complexity example, some twenty four pieces of different size and colour, have to be assembled into four interesting cubes, in a game activity context. Cubes themselves represent issue or topic consideration levels, such as 'business', 'brand', 'platform' and 'product'. Cube facets represent aspects, or strands and levels of complexity 'influences', such as 'strategies', 'processes', 'people' and 'enablers'. Printed upon each facet is a statement relevant to that level and aspect. These statements can be modified, allowing customisation for each complex situation. FIG. 45 represents such considerations.

Players or participants represent management and staff from different areas involved, directly or indirectly, in influencing and making decisions, including: Marketing; Brand Management; Finance; Human Resources; Research & Development; Design and New Product Development; Procurement & Supply Chain and Manufacturing. These people will likely already know the issues, but will not necessarily share a mutual understanding. The game activity represents a 'neutral' platform or vehicle to start communication and sharing of thoughts and experiences.

Preliminary game activity is symbolised by a 'Russian doll', that within it contains a series of smaller dolls. This sets the challenge and will start to pull participant teams together. At an individual level, the combination of this challenge and physical cube construction ensures the structured analysis or perception framework will be 'internalised' within in a participant organisation and used much faster than other management games and models.

Board Game

In order to make the transition from a pre-labelled generic construction model to one that applies to a particular organisation and/or (complex) situation, participants are presented a related follow-on board game challenge. In this, players have to formulate and explain their responses to different scenarios to the rest of the participants while their allotted playing piece incrementally traverses a game track or pathway. At the end of this phase, participants can see how their organisational systems react to, and cope with, change.

Visioning

In order to apply the game activity to participants' own organisation, a set of four blank cubes is used, with a supporting moderator or facilitator, to formulate and communicate a shared Vision stance for the organization. This set of cubes will contain statements reflecting a mutually agreed idealised stance, in sixteen facets at the four cube levels.

Action Plan and Implementation

Such a Vision set of cubes is used to define and plan realisation actions. Actions will be generated by comparing the ideal situation to the actual situation in each of the sixteen facets. These actions can then be prioritised and resources allocated.

Facilitation and Consultancy

Before playing the games the facilitator(s) needs to get some background information about the organisation. The game is first played with top management resulting in a shared high-level vision. This process is cascaded through the rest of the organisation resulting in a cohesive and detailed vision and implementation plan. During this part of the process:

the game will be played at the next levels potential internal facilitators will be identified and their training started the software will be configured and customised Hand-Over The aim is to 'internalise' the game activity efficiently into a participant organisation. Supporting consultancy facilitates the games, and also helps the organisation identify and address related issues and transfer of skills and expertise.

The process duration and resources required depend on many factors, such as company size, structure, leadership, people's motivation and resistance to change. The game activity is not a one-off event; it will become an integral part of an organisation's way of work and will form a reference framework.

Product Platforms

There are opportunities to develop other applications on the same platform. Thus, in a business context, game activity can be developed into a tool for:

Idea Management to capture and assess new ideas

Audit tool to assess company capability and status

Merger tool for organisational compatibility assessment, in take-over or joint venture scenarios Crisis Management Methodology Thus the game methodology was originally designed for the corporate sector, where increasing complexities have a detrimental effect upon ability to innovate products and services. However, the game activity methodology is more widely applicable to complex crisis management.

Overall, the game activity features a facilitation process, supported by a set of structured game tools—or toolset—that effectively deals with issues of complexity and alignment, enabling an organisation to align strategies, personnel, processes and technologies with situational demands, such as consumer needs.

Component List

| | |
|---|---|
| 11 | cube |
| 14 | linear grid |
| 15 | face(t) |
| 18 | playing surface |
| 19 | placement area |
| 22 | largest cube - organisation |
| 23 | second largest cube - brand |
| 24 | third largest cube - portfolio |
| 25 | smallest cube - product |
| 28 | end face |
| 29 | end face |
| 31 | playing path |
| 33 | strategy cards |
| 34 | enable cards |
| 35 | process cards |
| 36 | people cards |
| 38 | input cards |
| 39 | output cards |
| 43 | number cards |
| 44 | positioning grid |

The invention claimed is:

1. An analytical construction game comprising:

a plurality of multi-faceted elements configured as 3-D structures and dimensioned in different sizes so as to permit at least two of said faceted elements to nest together in a closely juxtaposed relationship, said multi-faceted elements being assembled from discrete facet pieces, having facet surfaces and edges configured for such assembly, said multi-faceted elements being configured in a plurality of sets for designated topic analysis, at least one of said elements having a facet carrying topic category indicia and another of said elements having a facet carrying related category indicia in a manner that when said facets are juxtaposed the designated topic is elucidated, said multi-faceted elements being sized in a scale of relative interest in the designated topic, ones of said facets being translucent permitting in the juxtaposed nested condition of at least two of the multi-faceted elements visual inspection of the underlying facet to reveal indicia relationships in the topic analysis.

2. The analytical construction game of claim 1 wherein said multi-faceted elements are configured as inter-nested 3-D cube structures.

3. The analytical game of claim 1 wherein said discrete-facet pieces comprise interlocking puzzle pieces.

4. The analytical game of claim 1 wherein said multi-faceted elements are formed from prefabricated templates, at least one of said templates comprising sheet material divided into a matrix of prospective facets, said sheet material being equipped with a line of perforations and fold and crease lines to facilitate erection into a 3-D structure.

* * * * *